US010594075B2

(12) United States Patent
Yaroslavskiy

(10) Patent No.: US 10,594,075 B2
(45) Date of Patent: Mar. 17, 2020

(54) ENHANCING CONNECTABILITY AMONG CONDUCTOR ELEMENTS

(71) Applicant: Carbine Ventures, Inc., New Brunswick, NJ (US)

(72) Inventor: Vitaliy Yaroslavskiy, Parlin, NJ (US)

(73) Assignee: CARBINE VENTURES, INC., New Brunswick, NJ (US)

( * ) Notice: Subject to any disclaimer, the term of this patent is extended or adjusted under 35 U.S.C. 154(b) by 0 days.

(21) Appl. No.: 16/126,578

(22) Filed: Sep. 10, 2018

(65) Prior Publication Data

US 2019/0103703 A1 Apr. 4, 2019

Related U.S. Application Data

(60) Provisional application No. 62/567,377, filed on Oct. 3, 2017.

(51) Int. Cl.
*H01R 11/09* (2006.01)
*H01R 13/621* (2006.01)
(Continued)

(52) U.S. Cl.
CPC ..... *H01R 13/6215* (2013.01); *H01B 7/282* (2013.01); *H01R 4/30* (2013.01); *H01R 11/09* (2013.01); *H01R 13/207* (2013.01)

(58) Field of Classification Search
CPC ... H01R 13/6215; H01R 13/207; H01B 7/282
See application file for complete search history.

(56) References Cited

U.S. PATENT DOCUMENTS 3,408,620 A * 10/1968 Damiano ..... H01R 4/363 439/797
3,594,703 A * 7/1971 Holtzapple ..... H01R 4/2483 439/416

(Continued)

FOREIGN PATENT DOCUMENTS

WO 2017030271 A1 2/2017

OTHER PUBLICATIONS

International Search Report dated Nov. 9, 2018. Applicant: Carbine Ventures, Inc. d/b/a Cable Technologies Laboratories, PCT application No. PCT/US18/50224 filed on Sep. 10, 2018.

(Continued)

*Primary Examiner* — Truc T Nguyen
(74) *Attorney, Agent, or Firm* — Shumaker, Loop & Kendrick, LLP; Jeffrey B. Fabian

(57) ABSTRACT

Assemblies and methods are provided for establishing an electrical connection and enhancing connectability that utilize an electrical connector having a housing and a socket for receiving an electrical conductor having multiple conductor elements or conductor layers. A conductive fastener extends through the housing into the socket. The fastener can penetrate multiple conductor elements to establish an electrical connection among conductor elements. One or more of the conductor elements can include a cutaway segment that receives a conductive fastener to establish an electrical connection among the connector, fastener, and multiple conductor elements. A conductive shim may be disposed about one or more of the conductor elements and received within the cutaway segment, and the conductive fastener can engage the conductive shim to establish electrical contact among multiple conductor elements through the shim.

21 Claims, 23 Drawing Sheets

(51) Int. Cl.

| | |
|---|---|
| ***H01R 13/207*** | (2006.01) |
| ***H01B 7/282*** | (2006.01) |
| ***H01R 4/30*** | (2006.01) |

(56) References Cited

U.S. PATENT DOCUMENTS

| | | | | | |
|---|---|---|---|---|---|
| 3,720,778 | A * | 3/1973 | Woertz | H01R 4/2483 | 174/59 |
| 3,816,817 | A * | 6/1974 | Ball | H01R 4/2483 | 439/416 |
| 3,922,058 | A * | 11/1975 | Kinnear | H01R 4/363 | 439/811 |
| 4,269,465 | A | 5/1981 | Mueller | | |
| 5,000,705 | A * | 3/1991 | Kinka | H01R 4/5091 | 439/791 |
| 5,266,057 | A * | 11/1993 | Angel, Jr. | H01R 4/5025 | 411/393 |
| 5,630,737 | A * | 5/1997 | Dupont | H01R 4/26 | 439/431 |
| 6,338,658 | B1 * | 1/2002 | Sweeney | H01R 4/36 | 439/709 |
| 6,875,045 | B1 | 4/2005 | Hollick | | |
| 7,014,514 | B2 * | 3/2006 | Zahnen | H01R 4/36 | 439/798 |
| 7,858,883 | B2 * | 12/2010 | Seraj | H01R 4/72 | 174/88 R |
| 8,550,842 | B1 * | 10/2013 | Gutierrez | H01R 4/72 | 439/521 |
| 8,747,170 | B2 * | 6/2014 | Cornelius | H01R 4/36 | 439/798 |
| 8,987,595 | B2 * | 3/2015 | Bumgarner | H01R 4/363 | 174/84 R |
| 9,379,531 | B2 * | 6/2016 | Boedec | H01R 4/021 | |
| 2006/0060373 | A1 * | 3/2006 | Gossmann | H01R 4/2483 | 174/94 R |
| 2010/0159737 | A1 * | 6/2010 | Elsaesser | H01R 4/2483 | 439/416 |
| 2012/0021634 | A1 * | 1/2012 | Stauch | H01R 4/307 | 439/359 |
| 2016/0226158 | A1 | 8/2016 | Cox et al. | | |
| 2016/0248209 | A1 | 8/2016 | Fong | | |
| 2017/0194725 | A1 * | 7/2017 | Peltier | H01R 4/307 | |
| 2018/0026383 | A1 * | 1/2018 | Stauch | H01B 1/023 | 439/804 |

OTHER PUBLICATIONS

Written Opinion dated Nov. 9, 2018. Applicant: Carbine Ventures, Inc. d/b/a Cable Technologies Laboratories, PCT application No. PCT/US18/50224 filed on Sep. 10, 2018.

* cited by examiner

Unitary Shim With Longitudinal Slits

ENHANCING CONNECTABILITY AMONG CONDUCTOR ELEMENTS

REFERENCE TO RELATED APPLICATION

This application claims priority to U.S. Provisional Application No. 62/567,377 filed on Oct. 3, 2017 the entirety of which is incorporated herein by reference.

TECHNICAL FIELD AND BACKGROUND

The present invention relates generally to devices and methods for enhancing the connectability of stranded or multilayer conductors.

The demands placed on power generation and distribution systems continue to increase leading to greater electrical loads placed on system components, such as cable conductors and connectors. Greater electrical loads increase heat generation that can cause cable failure.

In addition, power system components are generally designed to protect against rugged outdoor conditions, such as extreme temperatures and moisture intrusion, through the use of insulation, protective layers, and water-blocking and absorbent materials. The use of semi-conducting, water-blocking materials results in increased electrical resistance among conductor elements in a cable conductor. This in turn increases the heat generated by the cable and can also lead to failure as the cable operates closer to its maximum load capacity. This problem is particularly acute at cable terminating ends (terminal connectors) and cable joints (spliced conductors) as conventional connectors at such junctures tend to concentrate the electrical current on the outer conductor elements (e.g., outer strand layers) of a cable conductor.

Given the disadvantageous presented by existing connector components, it would be advantageous to provide a mechanism for enhancing the connectability between conductor elements or strand layers by promoting direct metal-to-metal contact between conductor elements. This would in turn improve the current distribution and resistance profiles across the cable cross section during load conditions and bypass the resulting effects of water-blocking materials. The result would be less heat generation and an accompanying improvement in reliability. Such a mechanism should preferably be capable of convenient and reliable installation under field conditions so as to control costs and reduce potential system down time associated with replacement of failed connector components.

It is, therefore, an object of the present invention to provide devices and methods for enhancing electrical cable connectability by providing a current path between conductor elements. It is a further object of the invention to provide devices that enhance connectability while being configured for convenient and reliable installation.

SUMMARY

A first embodiment provides an electrical connector assembly having a connector housing with a first axis extending between a first end with a first opening and a second end, and a second axis transverse to the first axis (i.e., radial direction for a tubular housing where the first axis is longitudinal), and an exterior surface. The housing also includes a socket cavity at least partially collocated with the first opening. The socket cavity extends along the first axis and defines an interior surface of the housing and is sized to receive an electrical cable conductor having at least two elements or at least two layers of strands. The housing also includes a passage that extends along the second axis from the housing exterior surface to the housing interior surface. The passage is sized to accommodate a conductive fastener having a first fastener end, a second fastener end, and a fastener first length extending between the first fastener end and the second fastener end. The fastener first length is sized so that when the socket cavity receives the electrical conductor and the conductive fastener is secured within the passage, the first fastener end extends into the socket cavity and penetrates into the multiple conductor elements or strand layers.

The first fastener end may be a penetrating portion, such as conical tip or sharp edge, and the conductive fastener can be, among other things, a screw, a rivet, or a shear both with multiple break points where a portion of the bolt is designed to shear off when subjected to a predetermined torsion load.

The connector can be a shear-bolt connector or a crimp connector that secures about an electrical conductor after the application of a force to crush a part of the connector housing. The passages can be pre-fabricated in the connector housing or formed by driving the conductive fastener through the housing exterior into the socket cavity.

In one embodiment, the connector housing includes additional openings, with the socket cavities defining channels sized to receive a further electrical cable conductor. The first passage forms an aperture on the housing exterior surface that is a first distance from the first end. The connector housing also includes a second passage that extends along an axis transverse to the first axis (i.e., radial direction for a tubular housing) from the housing exterior surface to the housing interior surface. Similar to the first passage, the second passage defines a second aperture on the housing exterior surface that is located further from the first end of the housing than the first aperture. The second passage is sized to accommodate a second conductive fastener with two ends and a length between the two ends. The fastener second length is sized so that when the socket cavity receives the second electrical cable, and the second conductive fastener is secured within the second passage, the fastener extends into the socket cavity and penetrates into the at least two conductor elements or strand layers of the second electrical conductor. One or more fasteners can have a penetrating end and be formed as a screw, rivet, or shear bolt with multiple break points, among other types of fasteners.

In yet another embodiment that does not necessarily utilize penetrating fasteners, the connector housing and socket receive an electrical conductor (or multiple conductors) with at least two conductor elements or strand layers, where at least one of the conductor elements ("a first conductor element") has a cutaway segment. The cutaway segment is formed when part of the conductor element or strand layer is removed to expose a second conductor element or strand layer. The conductive fastener length is sized such that when the socket cavity receives the conductor, and the conductive fastener is secured within the passage, an end of the conductive fastener extends into the socket cavity and establishes electrical communication with a second conductor element exposed through the cutaway segment.

The first and second conductor elements can be concentric (e.g., one outer conductor surrounding the second inner conductor), and the conductive fastener establishes electrical communication with the second conductor element by extending through the passage and into the cutaway segment to frictionally contact or engage the second conductor element. The cutaway segment can be formed as notch where part of the first conductor element is removed in a squared, rectangular, circular, or any other suitable pattern or shape to expose the second conductor. The cutaway segment can also be formed by removing an entire segment of the first conductor element through the entire cross section, such as removing a segment from the entire circumference of a circular conductor element.

In other exemplary embodiments, a conductive shim is disposed about the second conductive element at least partially within the cutaway segment to effectively fill some or the entire void created by removing the cutaway segment. The conductive shim is in electrical communication with the second conductor element. And the conductive fastener is placed in electrical communication with the second conductor element by extending the fastener through the passage into the socket cavity to engage the conductive shim.

Separate conductive shims can be used to establish electrical communication with each conductor element or strand layer. Alternatively, a single conductive shim can be disposed about the first conductor element at least partially within the cutaway segment and disposed about the second conductor element so that the conductive shim is in electrical communication with both the first conductor element and the second conductor element. In this case, the conductive shim has features on the interior surface that correspond to the cutaway segment and/or that correspond to the contours of the conductor elements so that the conductive shim can be installed over one or more of the conductor elements while establishing an electrical connection. The conductive fastener establishes electrical communication with both the first conductor element and the second conductor element by extending through the passage to engage the conductive shim.

The conductive shim can be formed from a malleable material so that it can be deformed, and press fit over one or more of the conductive elements to ensure a stable mechanical fit and electrical contact. Alternatively, the conductive shim can be formed as a helical element or compressible gland capable of mechanical deformation. In yet other embodiments, the conductive shim is an elongated hollow body with a slit extending down the length of the body to facilitate compression of the shim.

Also provided are methods for establishing an electrical connection and enhancing connectability among conductor elements or conductor strand layers. The method includes the steps of providing a connector with a housing that has a first axis extending between a first open end and a second end (e.g., axial direction for a rounded cable), and a second axis transverse to the first axis (e.g., radial direction for a rounded cable), and an exterior surface. The housing also has a socket cavity at least partially collocated with the first opening where the socket cavity extends along the first axis, defines an interior surface of the housing, and is sized to receive an electrical cable comprising at least two conductor elements. The housing further includes a passage that extends along the second axis from the housing exterior surface to the housing interior surface. The passage is sized to accommodate a conductive fastener.

The method further includes the step of providing a conductive fastener with a first end and a second end. An electrical cable is inserted into the first opening and into the socket cavity. Then the conductive fastener is inserted into the passage to a depth such that the conductive fastener extends into the socket cavity to establish electrical communication with the at least two conductor elements.

The electrical communication can be established by driving the conductive fastener into the passage until it extends into and penetrates the at least two conductive fasteners. In another embodiment, a cutaway segment is formed in a first conductor element to expose a second conductor element, and the conductive fastener establishes electrical communication with a second conductor element by extending through the passage and into the cutaway segment to engage the second conductor element.

In another embodiment, the method includes the step of installing a conductive shim at least partially within the cutaway segment so that the conductive shim is in electrical communication with a second conductor element. The conductive fastener establishes electrical communication with the second conductor element by extending through the passage into the socket cavity to engage the conductive shim.

BRIEF DESCRIPTION OF THE FIGURES

Features, aspects, and advantages of the present invention are better understood when the following detailed description of the invention is read with reference to the accompanying figures, in which.

DETAILED DESCRIPTION

Figure 1A:
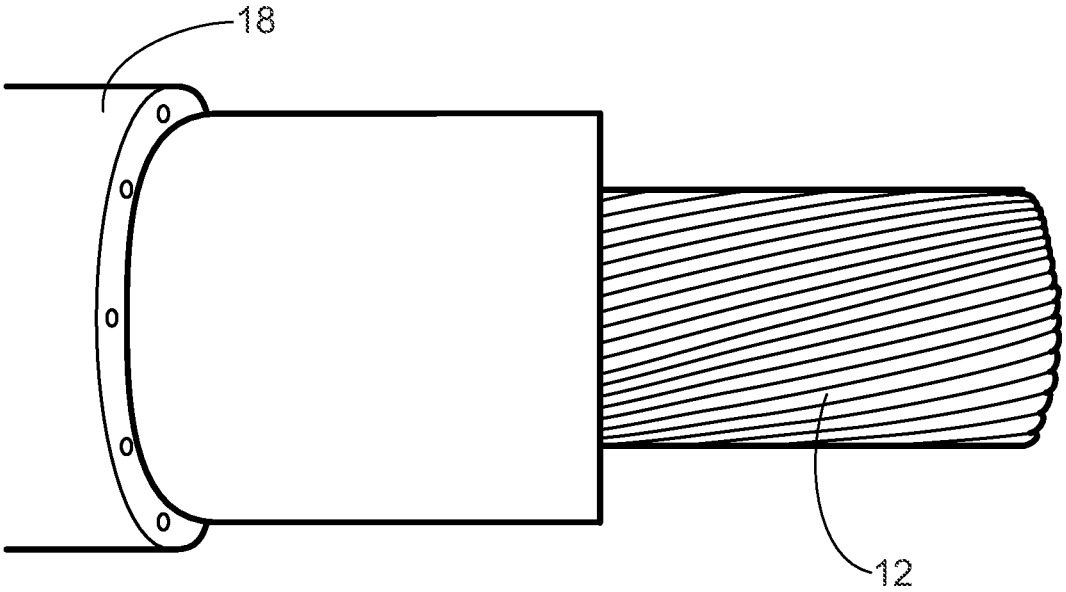
FIG. 1A illustrates an exemplary configuration for electrical cable construction.

The present invention will now be described more fully hereinafter with reference to the accompanying pictures in which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use, and practice the invention.

Relative terms such as lower or bottom; upper or top; upward, outward, or downward; forward or backward; and vertical or horizontal may be used herein to describe one element's relationship to another element illustrated in the figures. It will be understood that relative terms are intended to encompass different orientations in addition to the orientation depicted in the drawings. By way of example, if a component in the drawings is turned over, elements described as being on the "bottom" of the other elements would then be oriented on "top" of the other elements. Relative terminology, such as "substantially" or "about," describe the specified materials, steps, parameters, or ranges as well as those that do not materially affect the basic and novel characteristics of the claimed inventions as whole (as would be appreciated by one of ordinary skill in the art).

Figure 1B:
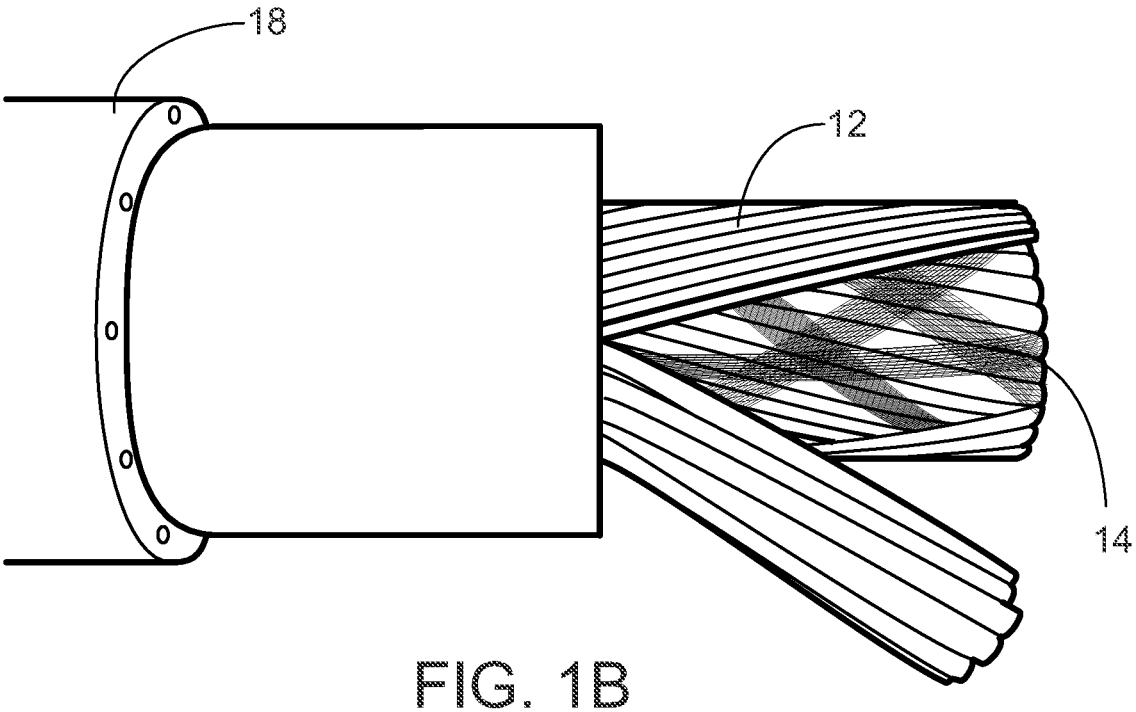
FIG. 1B illustrates an exemplary electrical cable using water-blocking yarn.
Figure 1C:
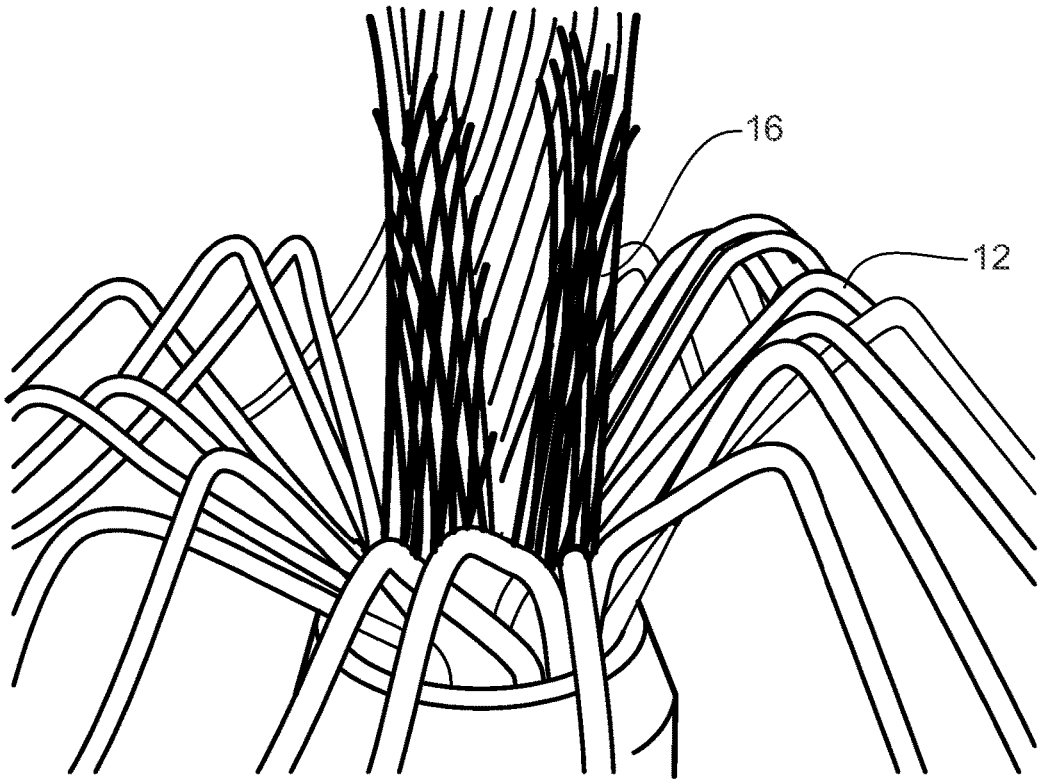
FIG. 1C illustrates an exemplary electrical cable using water-blocking tape.
Figure 1D:
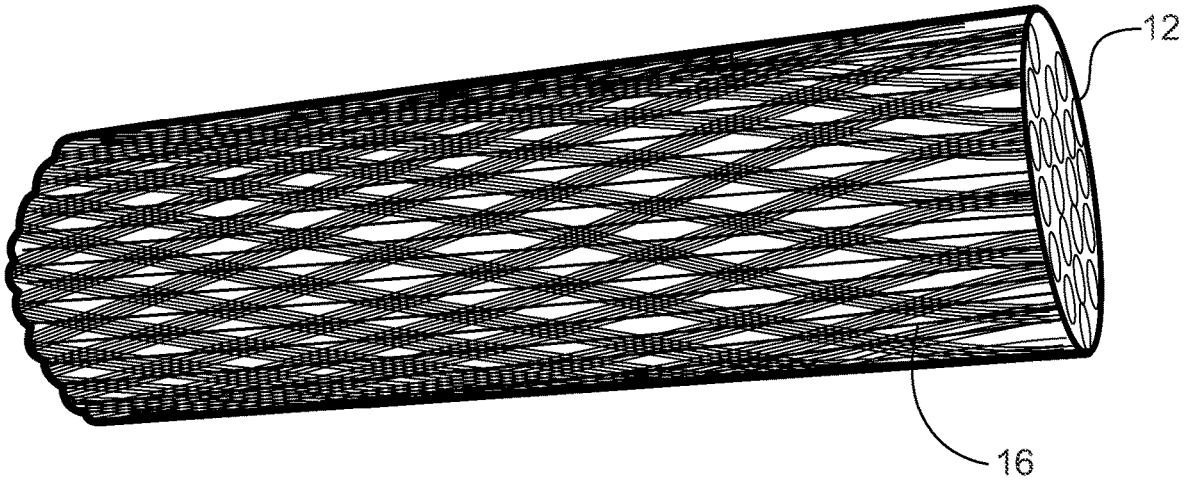
FIG. 1D illustrates an exemplary stranded conductor covered with a full layer of water-blocking tape.
Figure 1E:
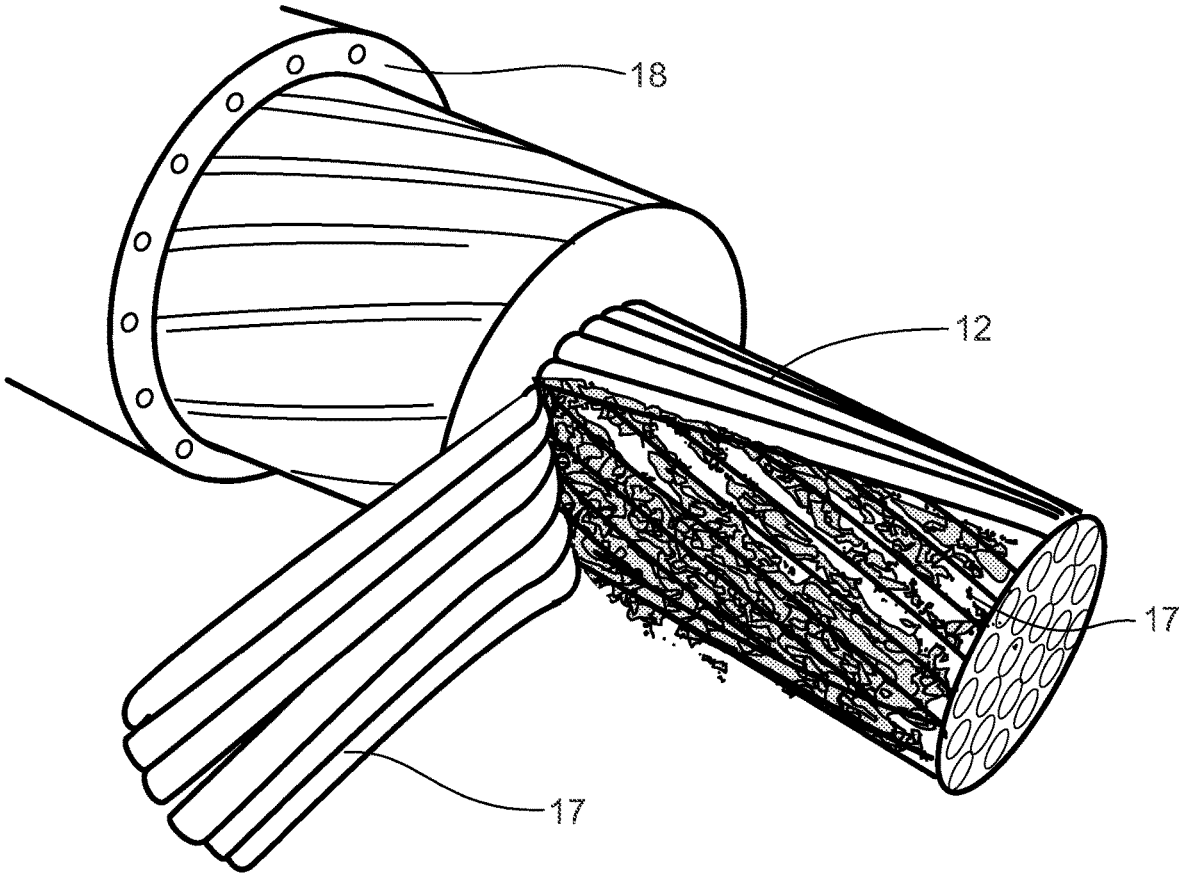
FIG. 1E illustrates an exemplary electrical cable using a pumpable water-blocking material.

Disclosed are devices and methods for improving the connectability among conductor elements in a multilayered conductor by establishing a current path among conductor elements, thereby bypassing the insulating effects of water-blocking and other insulating materials used in cable construction. The construction and configuration of electrical cables varies widely, but exemplary electrical cable embodiments are depicted in FIGS. 1A through 1F. The exemplary cables utilize stranded metallic conductor elements 12, insulated conductor sheathing 18, and one or more water-blocking materials 14, 16, and 17. The exemplary cable shown in FIG. 1B illustrates use of a water-blocking yarn 14. The exemplary cable shown in FIG. 1C illustrates a stranded conductor 12 using a water-blocking-tape material 16, and FIG. 1D illustrates a full layer of water-blocking tape 16 applied to the conductor 12. Use of a pumpable water-blocking material 17 is depicted in FIG. 1E where the pumpable material 17 is applied to the stranded cable in a viscous or gelatinous state that penetrate between strands before solidifying.

The multitude of layers and materials surrounding the conductor elements 12 enhance the physical integrity of the cables and protect the cables from environmental conditions but have the detrimental effect of impeding electrical communication among conductor elements. Impeding electrical communication among conductor elements increases the overall resistance of the cable, which in turn leads to increased heat generation within the cable when carrying an electrical load. The increased heat is a significant contributing factor to cable failure. The problem of cable overheating is exacerbated by conventional connectors that establish an electrical connection principally with outer conductor elements or strand layers, thereby concentrating the current and heat generation in a smaller cross-sectional area of the cable.

Figure 2:
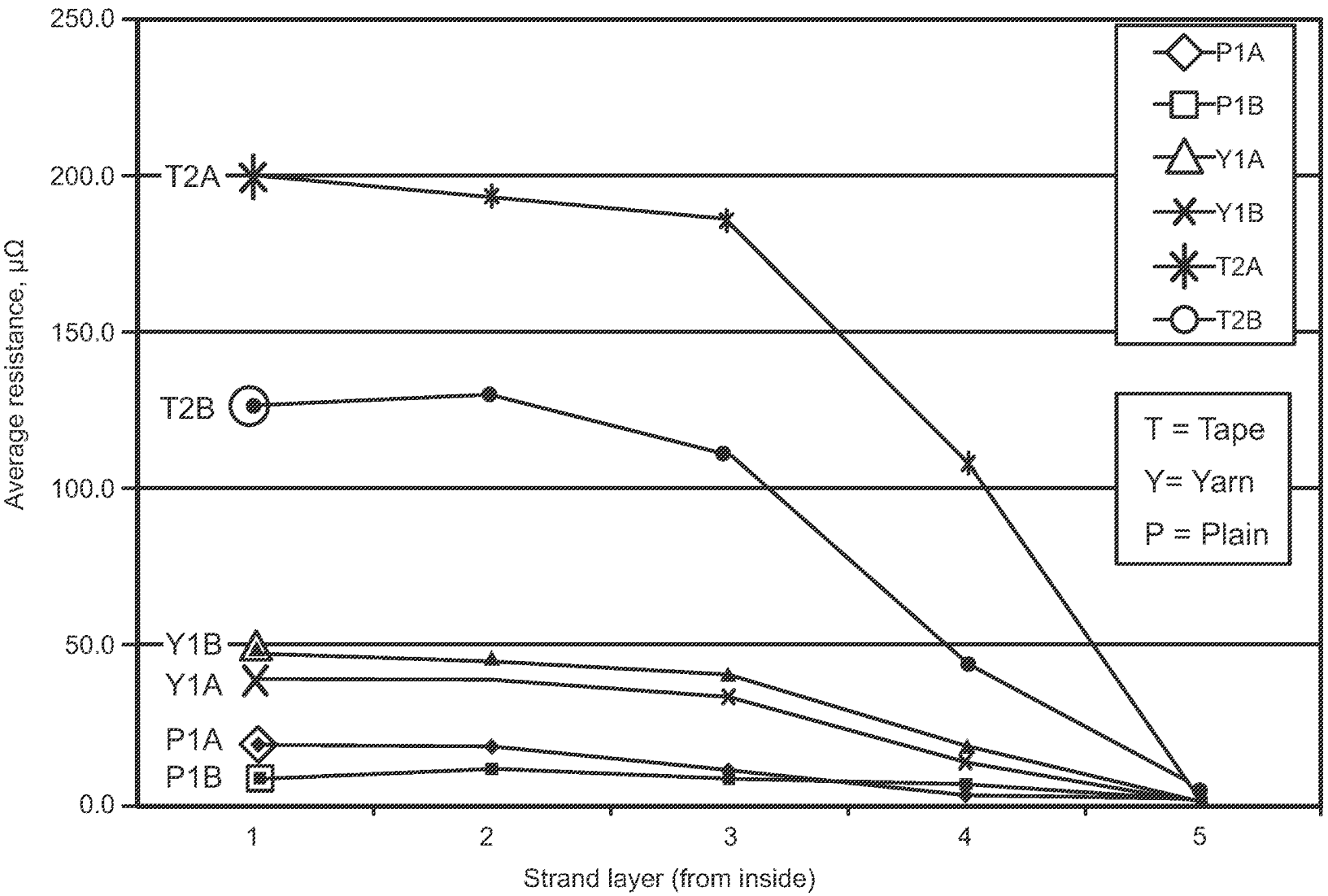
FIG. 2 is a graph of resistance between a conductor strand layer and connector body for various cable configurations (yarns, tapes and pumpable).
Figure 3:
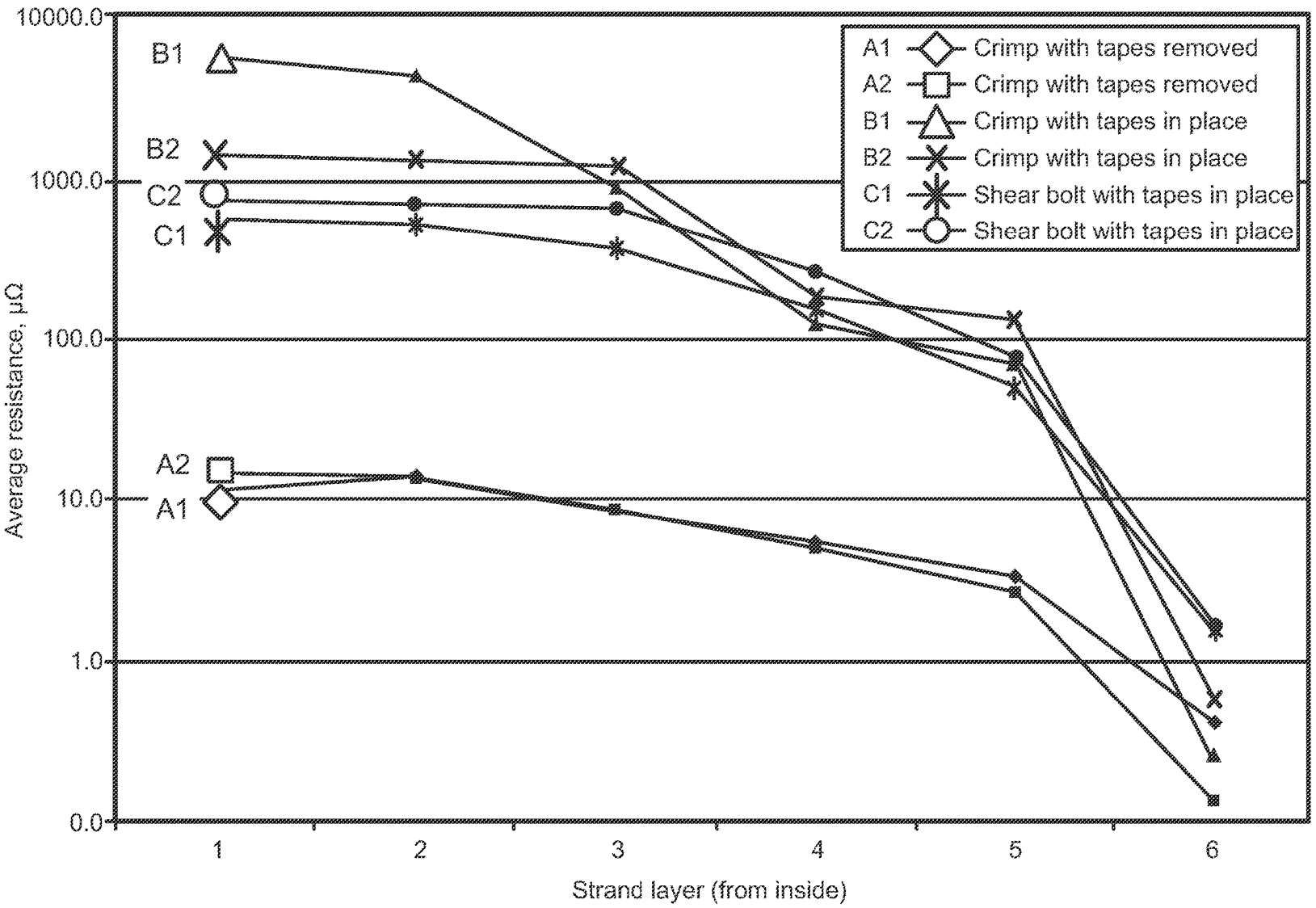
FIG. 3 is a graph of conductor strand layer resistance for various connector and cable configurations.

FIG. 2 illustrates the impact of water-blocking materials on conductor strand layer resistance at a splice point for an aluminum conductor with a cross sectional area of 1,000 kilo circular mils (kcmil). Notably, the conductors utilizing water-blocking yarns (lines Y1A & Y1B) and tapes (T2A & T2B) have a significantly higher resistance than plain conductors without water-blocking materials (P1A & P1B), and the inner conductor strands (towards the left on the horizontal axis) have higher resistance than the outer strands. These trends hold true across connector types, as illustrated in FIG. 3, which compares the use of water-blocking materials in cables with both crimp and shear-bolt connectors to the use of a cable without water-blocking materials. Both crimp connectors (lines B1 & B2) and shear-bolt connectors (lines C1 & C2) used in combination with water-blocking tapes have approximately 100 times greater resistance than a crimp connector that does not utilize a water-blocking material (lines A1 & A2). In short, the water-blocking materials have a significant detrimental impact on cable resistance at splice points, and the detrimental impact is more pronounced at the inner conductor elements or strand layers of a cable.

The devices and methods discussed herein are directed to improving the electrical resistance characteristics at conductor splice and termination points and are particularly effective for conductors that utilize water-blocking or other insulating materials. The disclosed embodiments are generally described with reference to cylindrical, shear-bolt, splice connectors utilized in combination with multilayer, stranded conductors. However, those of skill in the art will appreciate that the exemplary embodiments described herein are not intended to be limiting.

The inventive devices and techniques are generally applicable to electrical cables with multiple conductor elements, such as those shown in FIGS. 1A-E, or with multiple layers of conductor strands, such as those shown in FIGS. 6A-6C, 7, 12A, 13A-13B, and 14A-14B that are discussed in more detail below. The inventive devices and techniques are also generally applicable to various connector types and geometries, including, for example, terminal or splice connectors, shear-bolt or crimp connectors, or connectors with circular, c-shaped, or squared cross-sections, as well as multi-way splices.

Terminal connectors generally comprise a conductive partially hollow body or housing with one or more socket openings defining the interior of the housing. The socket is configured to accommodate and firmly secure the end portion of one or more cables. The socket may define a channel through the housing, or the socket can be formed from halves or shells of the connector housing joined to form a channel.

Figure 4:
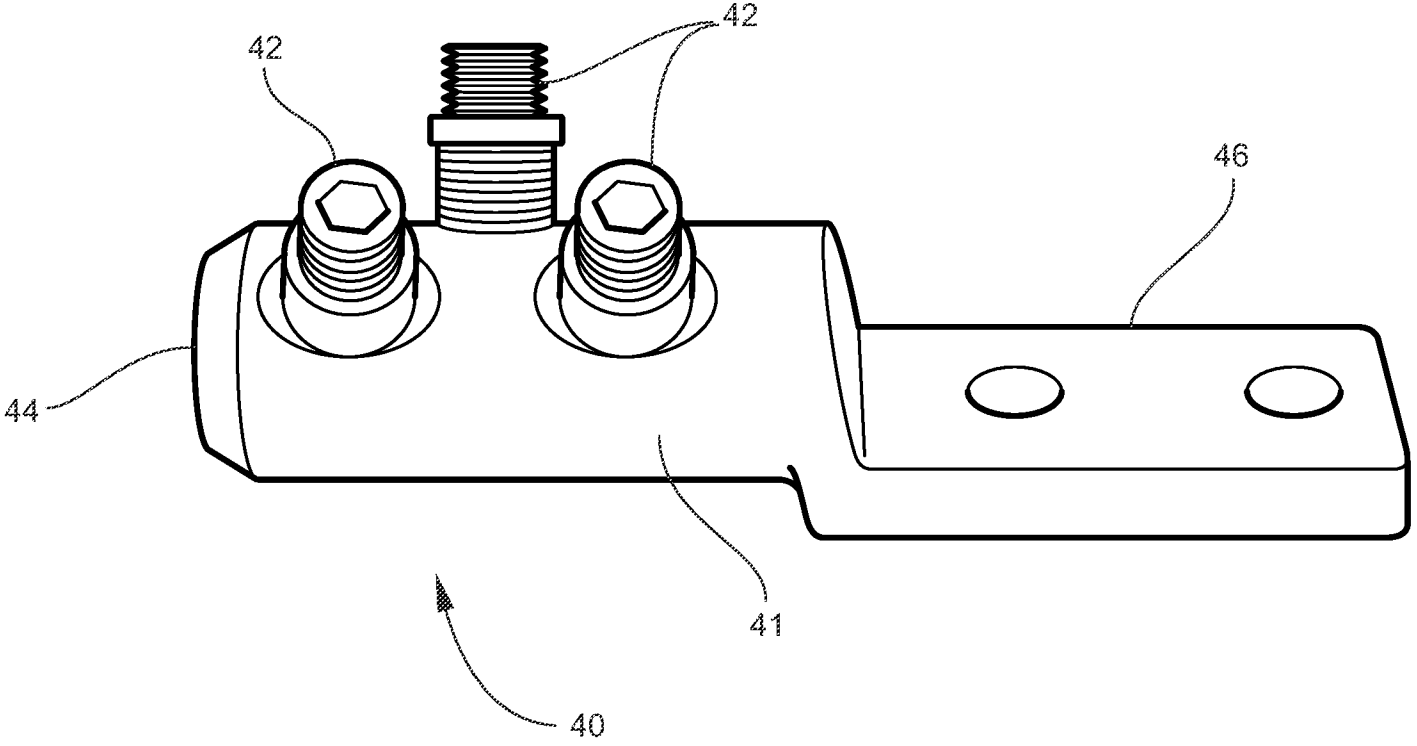
FIG. 4 illustrates an exemplary terminal, shear-bolt connector.

In crimp connectors, the end portions of the cables are secured in position within the connector socket by crimping the connector housing onto the cables after insertion into the socket. With shear-bolt connectors, the end portions of the cables are secured within the socket by shear bolts that extend through the connector housing to apply force to the cables. An exemplary shear-bolt, terminal connector 40 is shown in FIG. 4 and includes a hollow tubular body or housing 41 with a single socket opening 44 to accommodate a cable end, a plurality of shear-bolt fasteners 42 threaded through the connector housing 41 to the socket, and a lug 46 for securing the connector to a terminal.

Figure 5B:
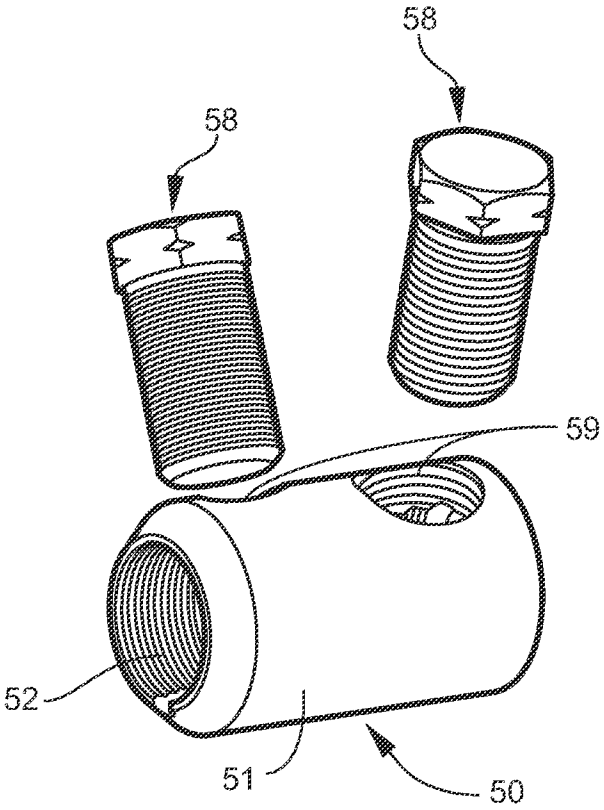
FIGS. 5A and 5B illustrate an exemplary splice, shear-bolt connector.
Figure 5A:
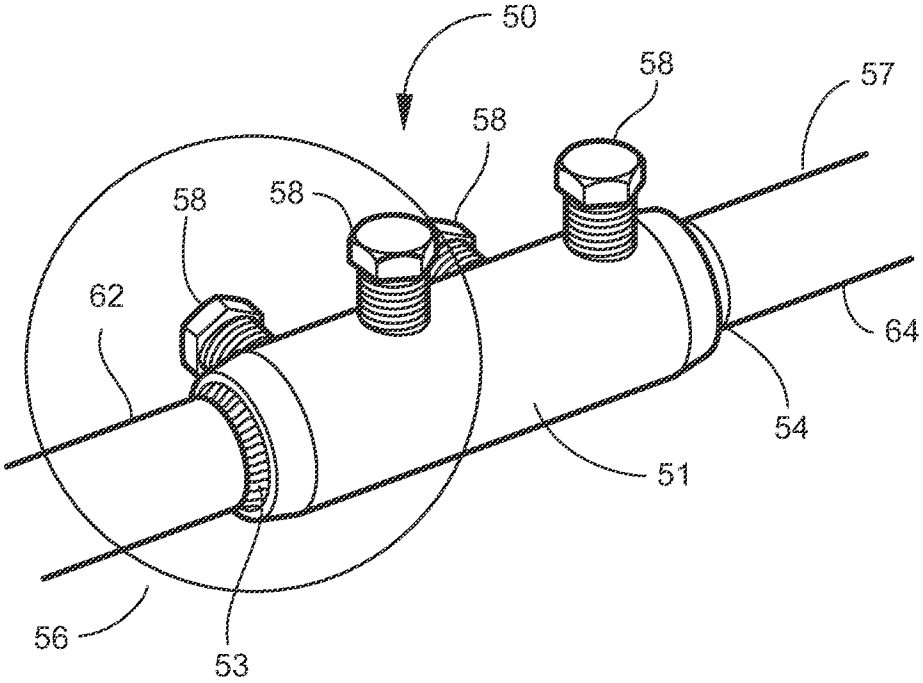

Similarly, splice connectors generally comprise a conductive hollow body or housing with one or more socket openings configured to accommodate and secure in position the end portions of two or more cables that are to be electrically connected. An exemplary shear-bolt, splice connector 50 is shown in FIGS. 5A and 5B and includes: (i) a hollow tubular housing 51 with a socket 52 defining a channel or cavity through the interior of the housing 51; (ii) two socket openings 53 & 54 that each accommodate a cable end 62 & 64; and (iii) a plurality of shear-bolt fasteners 58 threaded within passages 59 extending through the sidewall of the connector housing 51.

To electrically couple the cables, a first cable end 62 is inserted into the first connector socket opening 53 at a first end 56 of the connector housing 51, and a second cable end 64 is inserted into the second socket opening 54 at a second end 57 of the connector. The shear-bolt fasteners 58 are threaded into the passages 59 until the shear-bolt fasteners 58 extend into the socket 52 to engage and exert pressure on the cable ends to secure the cable ends in place within the connector socket 52. The head of the shear-bolt fastener 58, and in some cases part of the stem, is designed to shear off when the bolt 58 is subjected to a predetermined torsion load. At least a portion of the shear-bolt stem remains within the passage 59 after shearing. Preferably, the bolt shears such that the stem does not extend beyond the exterior surface of the connector housing 51.

The shear bolts will commonly establish metal-to-metal contact principally or exclusively with the outer conductor elements either because the protective insulating layers were stripped during connector installation or because the pressure exerted by the shear-bolt fasteners pierced the protective insulation surrounding the outer conductor elements.

In other cases, piercing connectors are used that include serrated edges or tines within the socket that are configured to pierce the protective insulation or protective layers surrounding the outer conductor elements to establish a direct current path between the outer conductor elements and the connector housing. Establishing a current path between the outer conductor elements and the connector housing effectively lowers the electrical resistance of the outer conductor elements relative to the inner conductor elements. However, these connectors are not intended to pierce the conductor layers to provide continuity to the inner member of the strand layers.

Figure 6A:
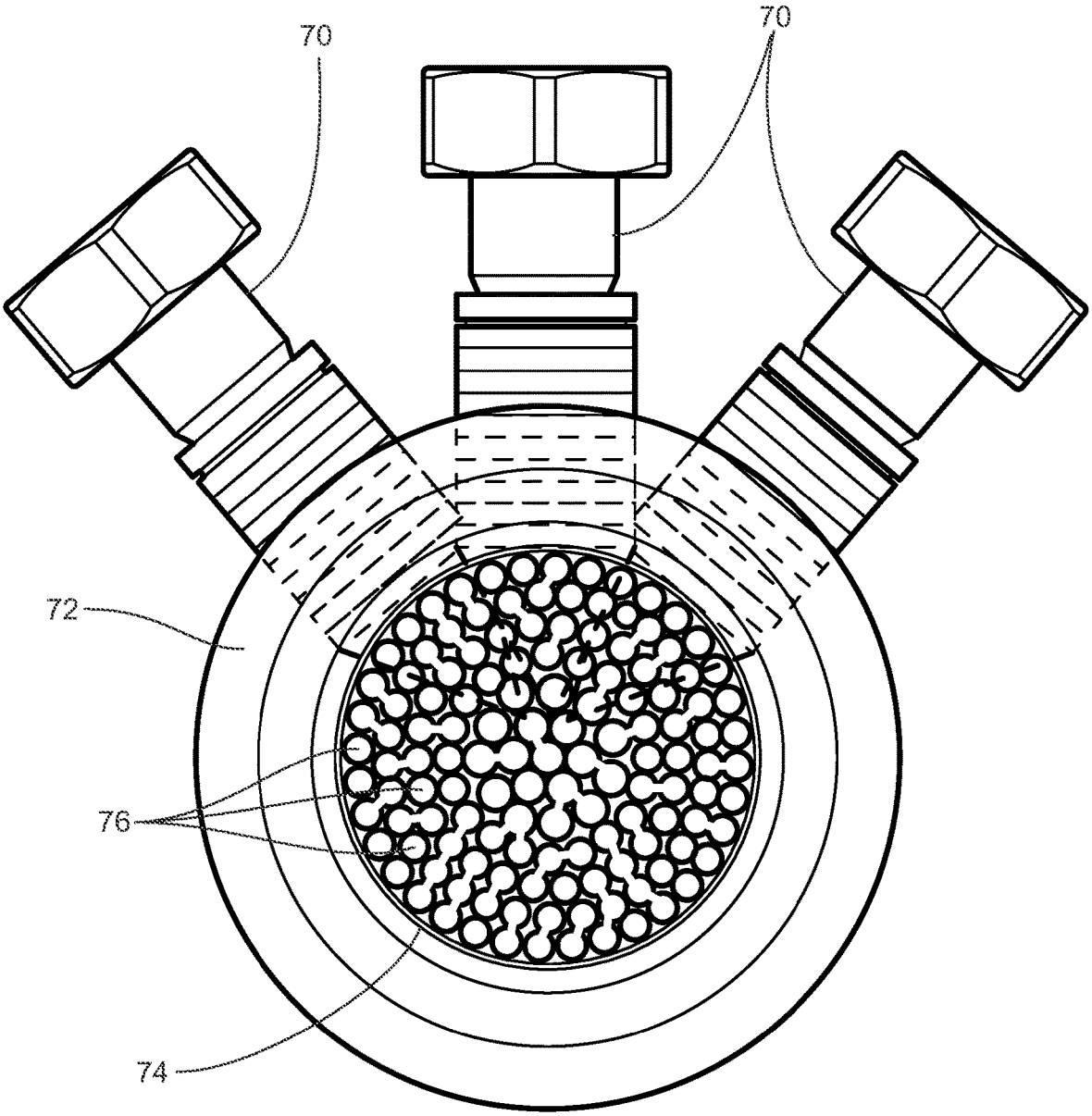
FIGS. 6A-B illustrates a cutaway, cross-sectional view of an exemplary connector assembly using penetrating, conductive shear-bolt fasteners.
Figure 6B:
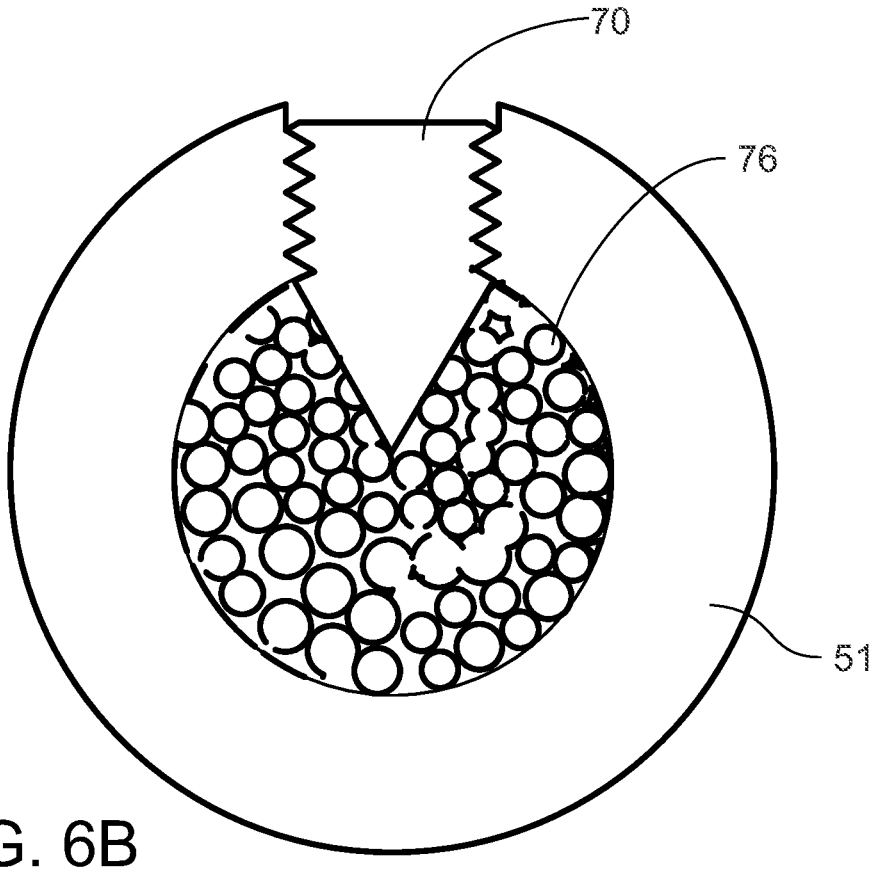
Figure 6C:
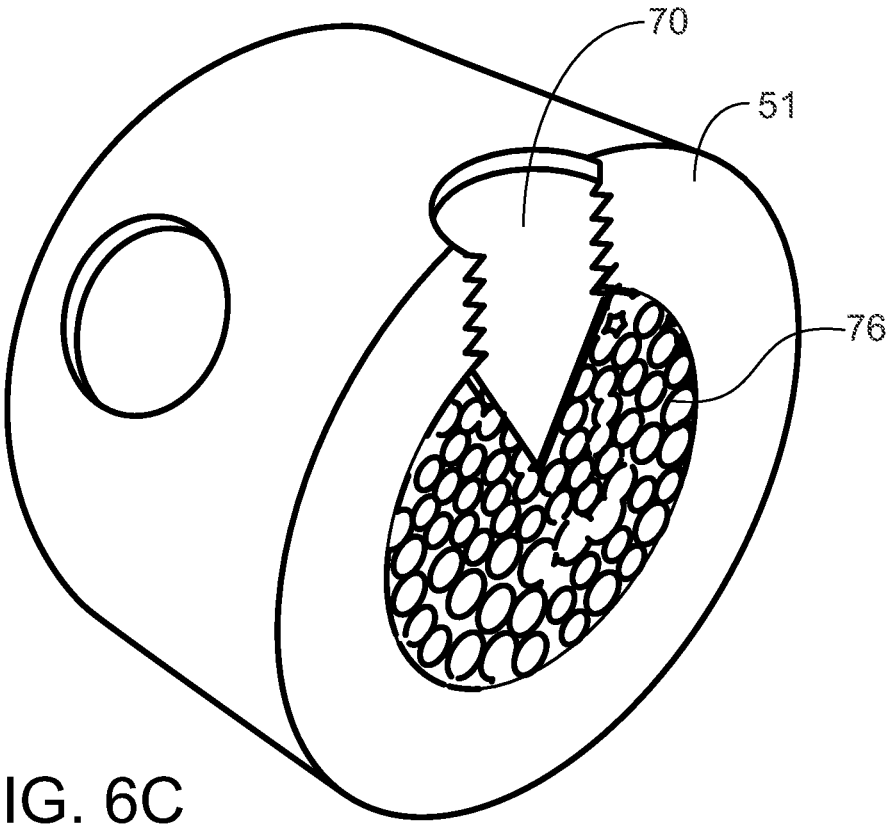
FIG. 6C illustrates an isometric view of an exemplary connector assembly using penetrating, conductive shear-bolt fasteners.

The electrical resistance and current concentration profiles across a cross section of cable can be improved through the use of the penetrating, conductive shear fastener design shown in FIGS. 6A-6C and 7. The connector assembly depicted in FIGS. 6A-C utilizes conductive, penetrating shear fasteners 70 disposed in the connector housing 51 that extend into the socket 52 through multiple conductor strand layers 76. FIGS. 6B and 6C illustrate the strand layers 76 being displaced by the conical, penetrating portion of the shear fastener 70 as the shear fastener 70 extends into the socket 52. In this manner, a direct current path is created among conductor elements or strand layers 76 via the conductive, penetrating shear-bolt fastener 70, thereby more evenly distributing the load current among conductor elements or strand layers 76 and reducing the tendency for load current concentration within the outer conductor elements or strand layers 76.

The current distribution over a cable cross section improves as electrical communication is established among additional conductor elements or additional strand layers 76. However, the conductive fasteners 70 do not need to extend through all of the conductor elements or strand layers 76 to realize a significant improvement in the current concentration profile. This is in part because most of the cross-sectional area for a multi-layered cable is encompassed within the outer-most conductor elements or strand layers 76.

Figure 7:
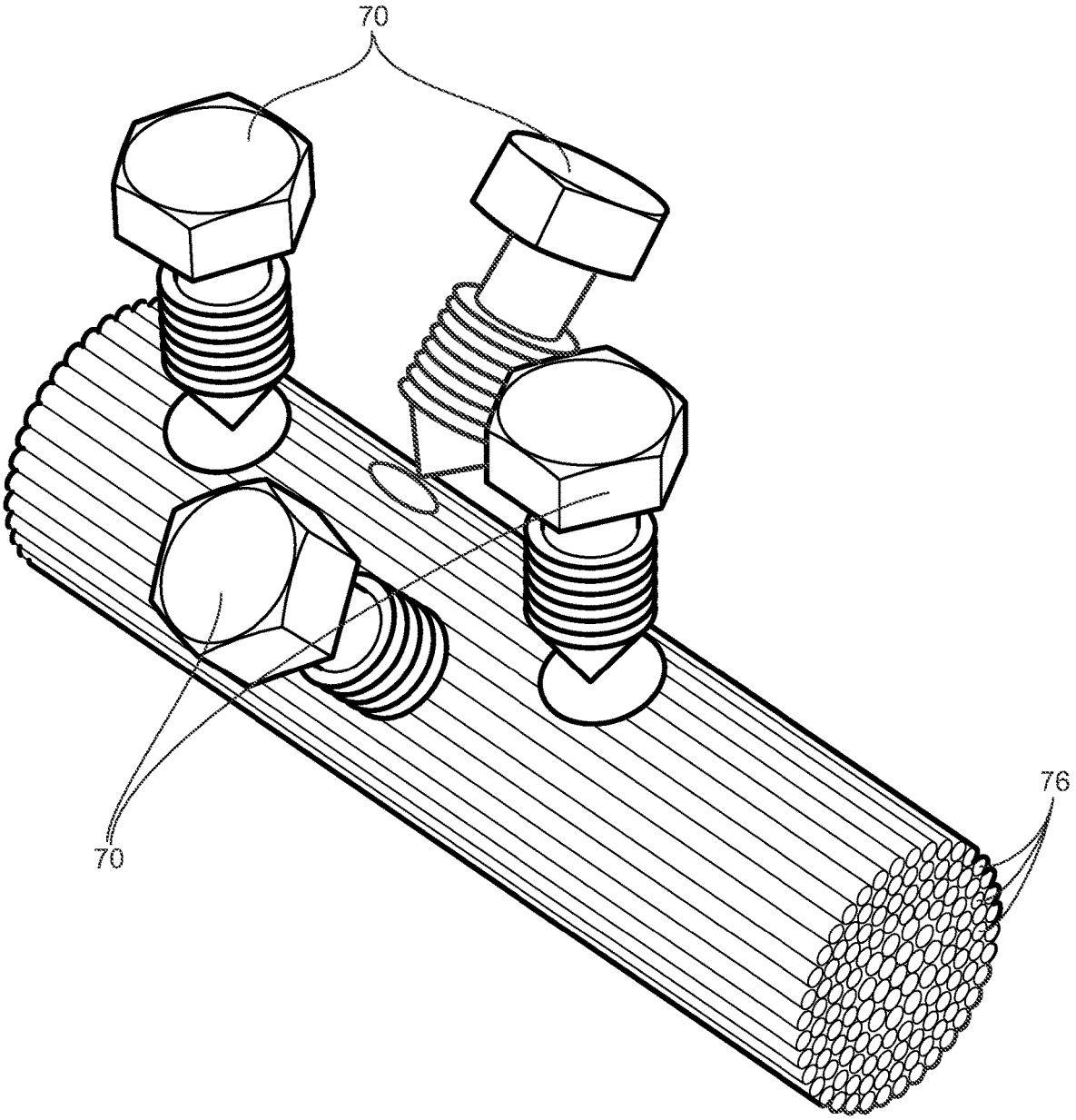
FIG. 7 is a perspective view of an exemplary penetrating conductive fastener configuration.
Figure 8:
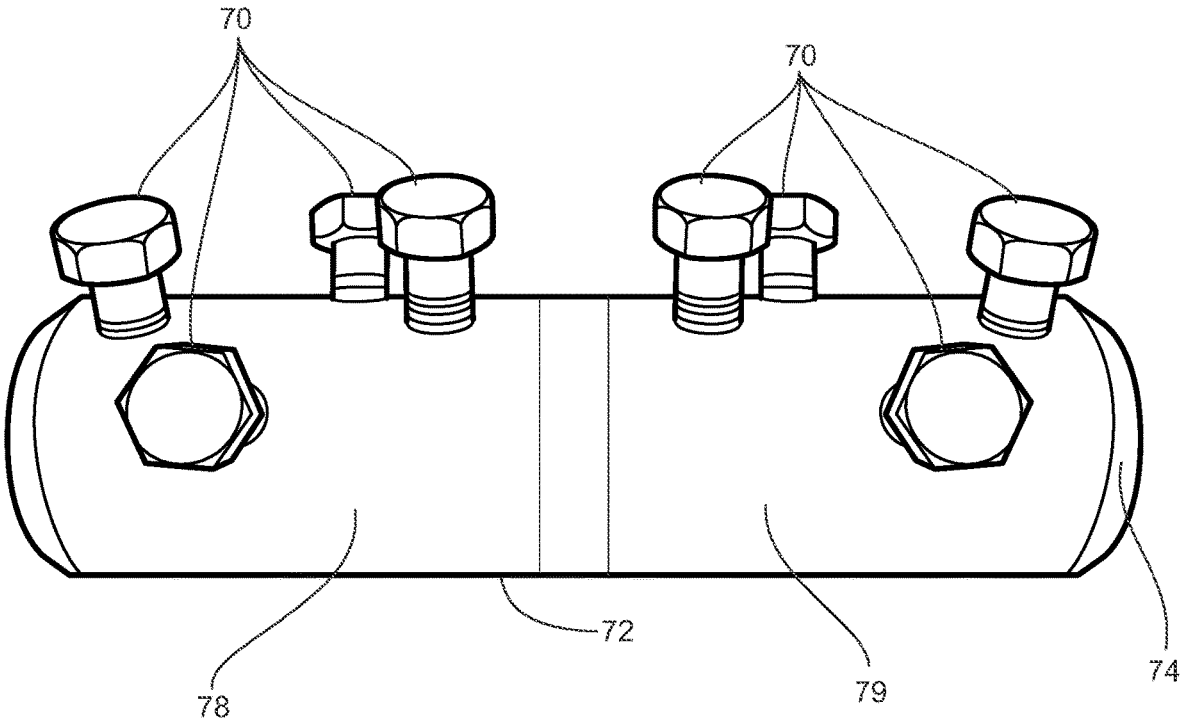
FIG. 8 illustrates an exemplary splice connector assembly using penetrating, conductive shear-bolt fasteners.

The embodiment of FIG. 6A shows three penetrating shear-bolt fasteners 70 oriented at an approximately forty-five degree angle relative to one another, but those of skill in the art will appreciate that any suitable number of conductive fasteners 70 at any suitable relative orientation can be used. The embodiment shown in FIG. 7 illustrates the use of four penetrating shear-bolt fasteners 70 arranged in alternating angular positions along the axial direction of a multilayered, stranded conductor. The embodiment shown in FIG. 8 illustrates the use of the same alternating four-shear-bolt fastener configuration on both sides 78 & 79 of a splice connector 50 where four penetrating shear-bolt fasteners 70 are used to secure each of two cable ends inserted into opposite sides of the connector housing 51.

Figure 9:
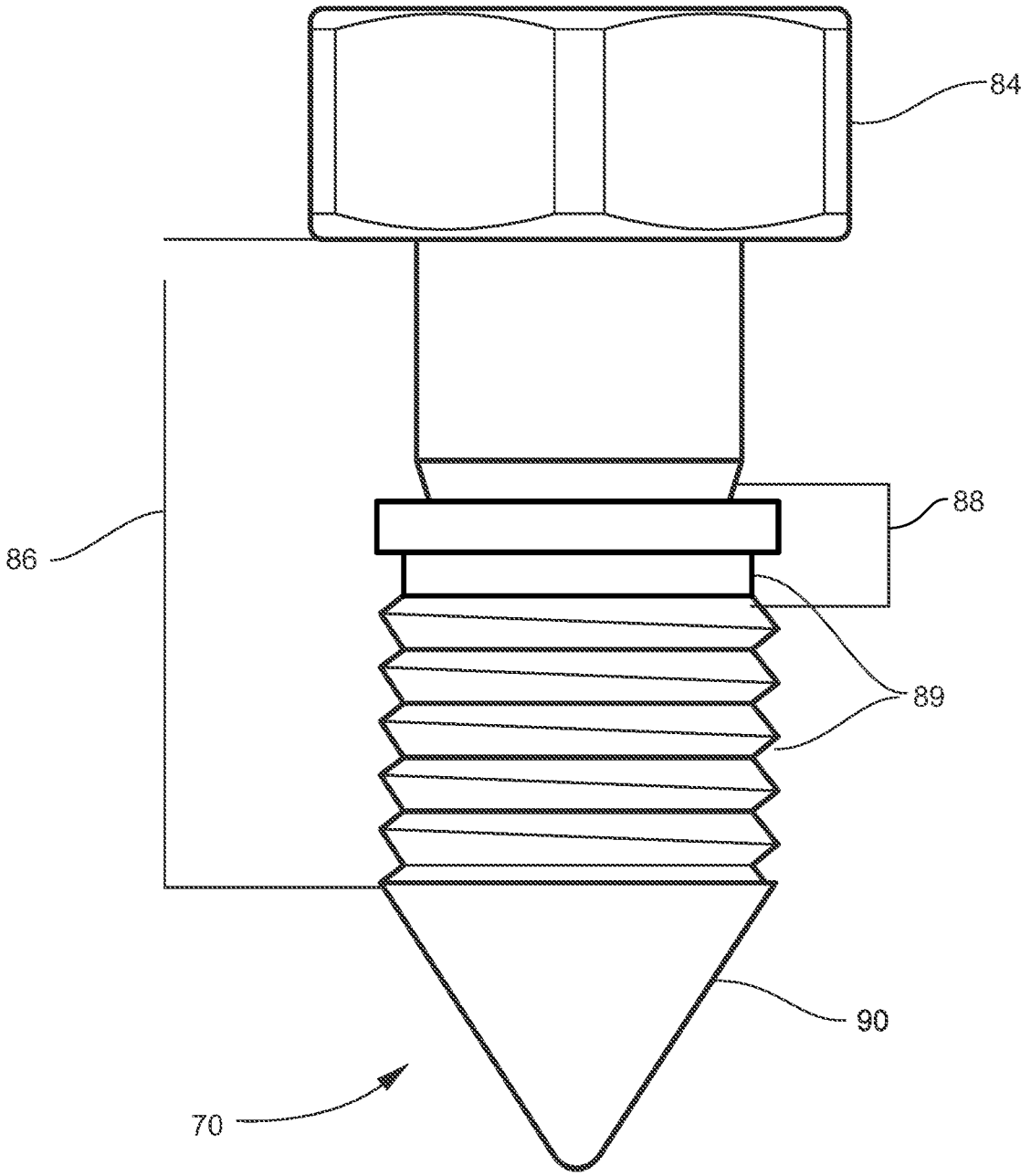
FIG. 9 illustrates an exemplary shear bolt.

Details of an exemplary conductive, penetrating shear-bolt fastener are shown in FIG. 9. The conductive, penetrating shear-bolt fastener includes a fastener head 84, a stem 86 that may include one or more break points 88, a threaded portion 89, and a conical penetrating portion 90 or tip. The conductive, penetrating shear-bolt fastener 70 embodiments depicted in the attached figures are secured within the connector housing by threading the fasteners 70 through threaded passages 59 in the housing 51. The penetrating end portion 90 facilitates penetration through the conductor elements or strand layers 76, in contrast to the planar or flat end of a conventional shear-bolt fastener depicted in FIG. 5B that merely contacts the outer conductor elements.

Use of threaded conductive, penetrating shear-bolt fasteners 70 and multiple shear break points 88 allows the fasteners 70 to be screwed to a desired depth within the conductor elements before breaking off a portion of the fastener 70 at one of the break points 88. This allows a single conductive, penetrating shear-bolt fastener 70 to accommodate connectors and cables of varying thicknesses or cables with a varying number of strand layers 76 to be penetrated. Although threaded conductive, penetrating shear-bolt fasteners offer the advantage of convenient and precise control over penetration depth, those of skill in the art will recognize that other types of fastening means can be used to secure conductive fasteners within the connector housing and to penetrate the conductor elements, such as nails, screws, or rivets. The passages 90 can be pre-formed in the connector housing 51 or created when the conductive fasteners 70 are driven through the connector housing 51 during fabrication or installation.

Figure 10:
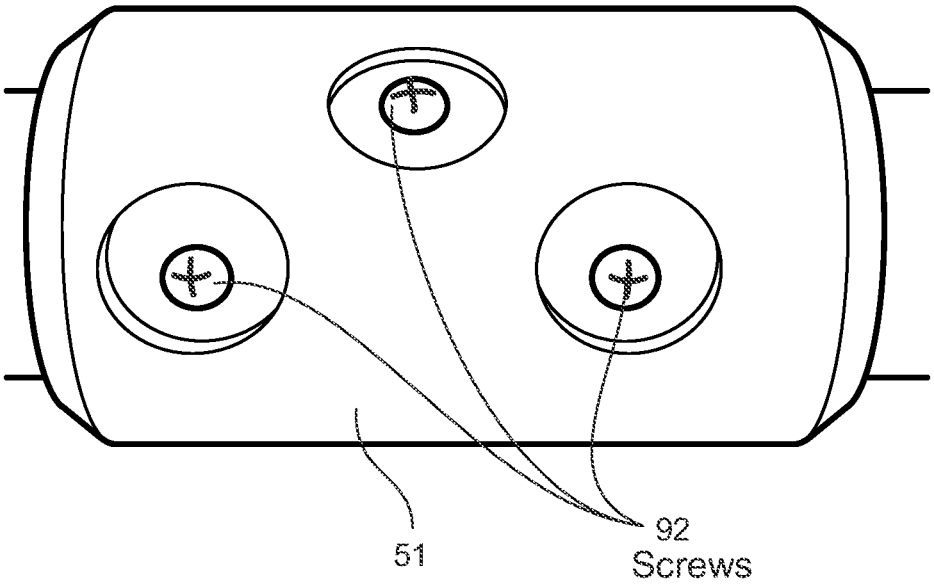
FIG. 10 illustrates an exemplary splice, shear-bolt connector assembly using penetrating, conductive screw fasteners.
Figure 11:
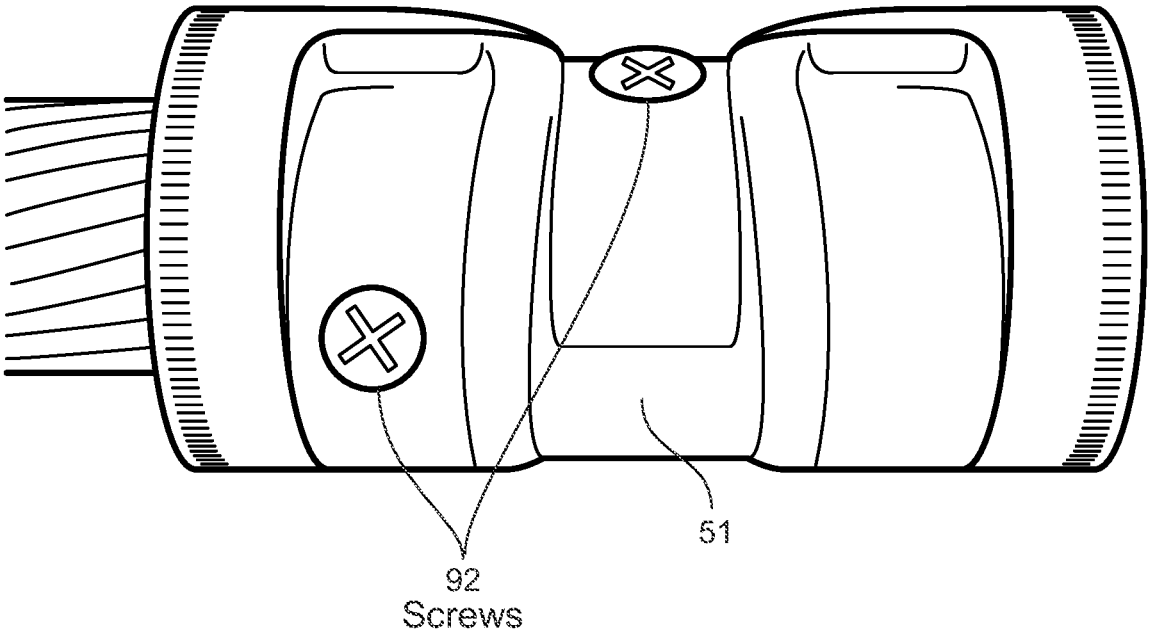
FIG. 11 illustrates an exemplary crimp connector assembly using penetrating, conductive screw fasteners.

FIGS. 10 and 11 illustrate the use of screws 92 as conductive, penetrating fasteners in both a shear-bolt connector (FIG. 10) and a crimp connector (FIG. 11). As with the penetrating shear-bolt configuration shown in FIG. 6, the screws 92 are driven to a desired depth through the connector housing 51 and through multiple conductor elements or strand layers 76 to enhance connectability by establishing a direct current path among conductor elements or strand layers 76 via the penetrating fastener 92. The length of the screw and the drive depth can be selected such that the head of the screw does not extend significantly beyond the exterior surface of the connector housing 51, thereby obviating the need to shear off the head of the fastener as in shear-bolt fasteners.

In other embodiments, the conductor elements or strand layers 76 can be modified (during splicing, for example) to enhance connectability among conductive elements or strand layers and to permit the use of either penetrating fasteners or conventional shear-bolt fasteners while still establishing a current path among conductive elements or strand layers. The exemplary embodiment shown in FIG. 12A utilizes notches 102*a-b*, or segments cut from each strand layer or through successive strand layers. For instance, the first notch 102*a* in FIG. 12A cuts away the outer most strand layer while the second notch 102*b* cuts away the two outer most strand layers.

Figure 12A:
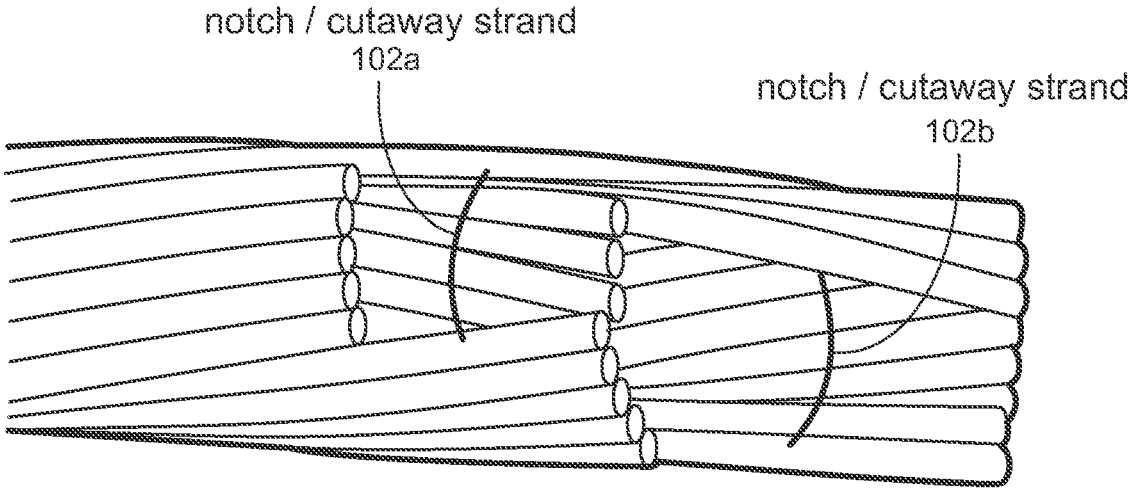
FIG. 12A illustrates a layered, stranded conductor with notched cutaways.
Figure 12B:
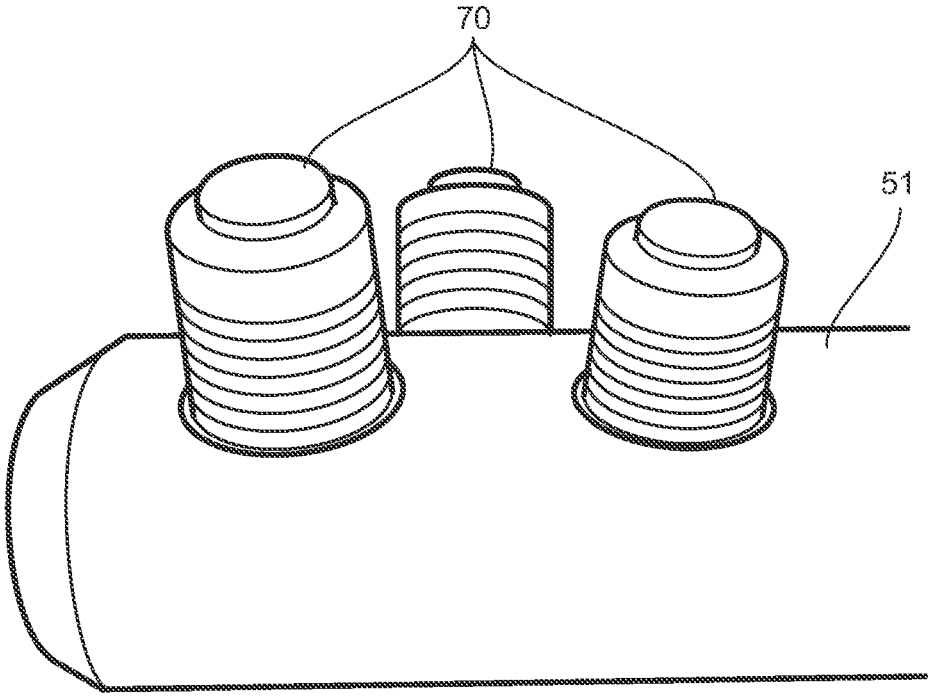
FIGS. 12B-D illustrates an exemplary connector assembly using penetrating, conductive shear-bolt fasteners.
Figure 12C:
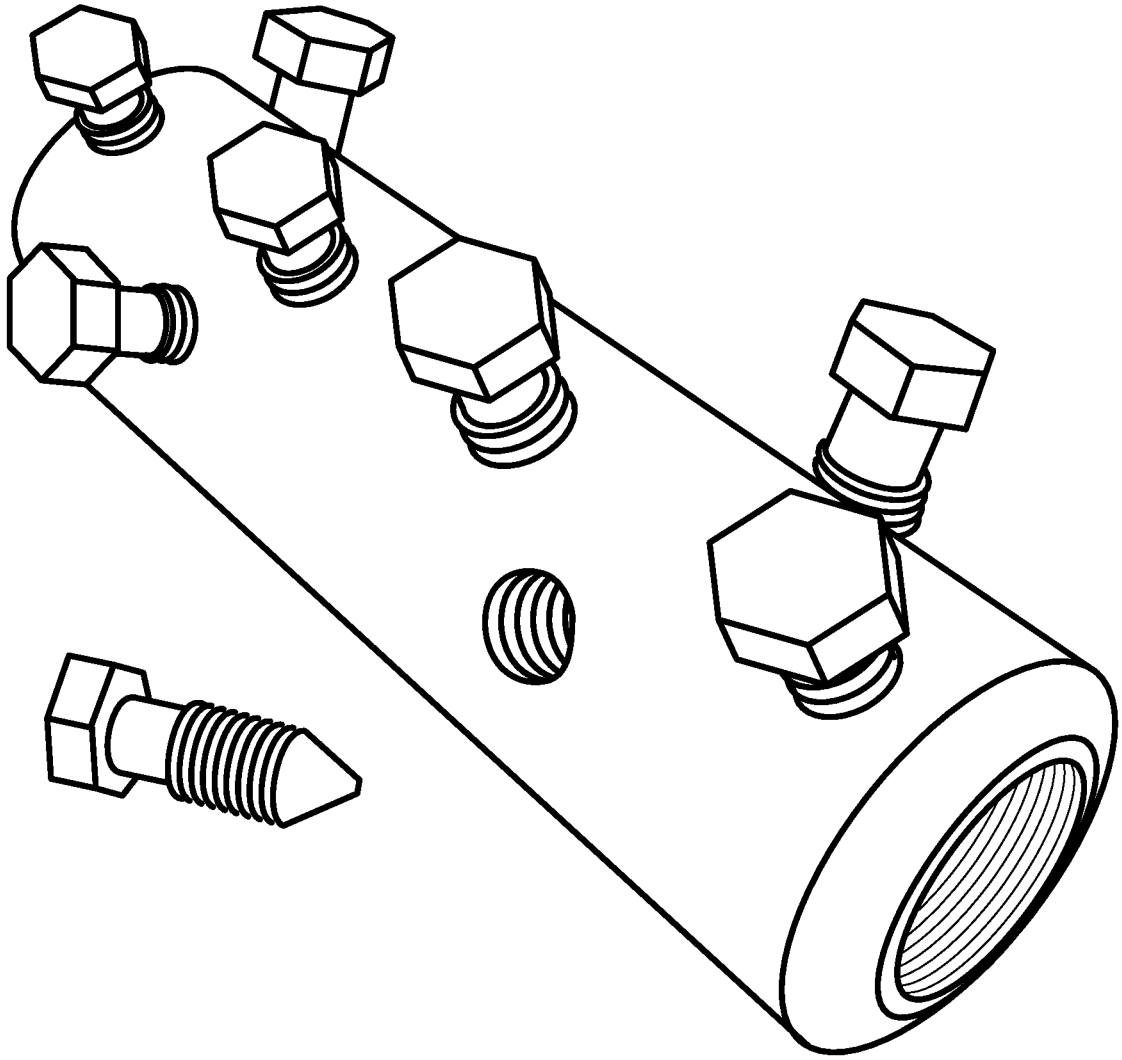
Figure 12D:
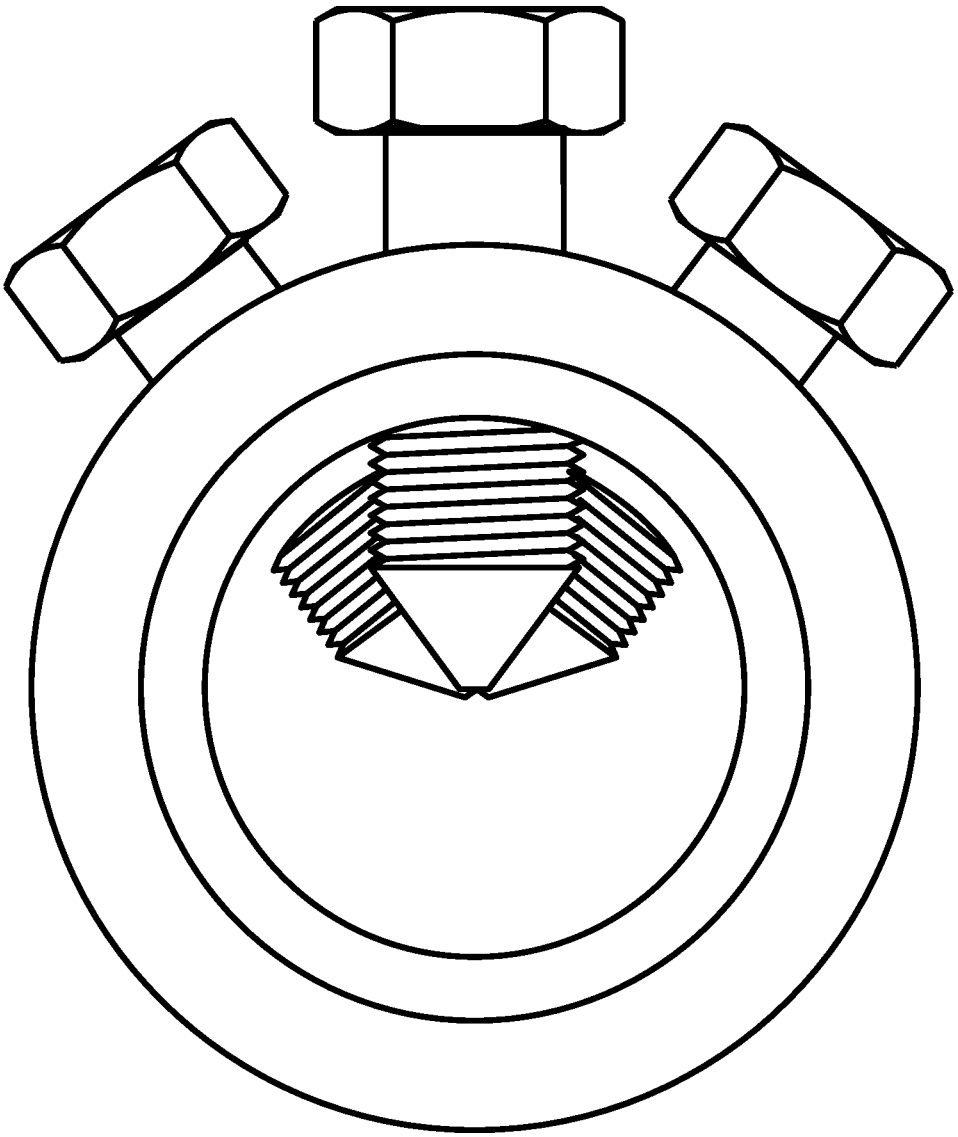

The notches 102*a-b* are arranged in an alternating or offset fashion that corresponds to the arrangement of the fasteners 70 that extend through the connector housing 51, as illustrated in FIGS. 12B-12D. In this manner, after extending through the connector housing 51 via the passage 59, each fastener 70 can establish contact with a different conductor element or strand layer 76 of varying depth into the cable without having to penetrate the conductive elements or strand layers 76. This also permits the cable radius or thickness an axial distance away from the fasteners 70 to be left unchanged so that a design pressure between the outer cable surface and the connector socket interior surface remains sufficiently large enough to secure the cable within the connector. A current path is established among strand layers through both the fastener 70 and the connector housing 51. Notably, with the method shown in FIG. 12A, each fastener 70 must be driven to a different depth through the connector housing 51, which can complicate installation of the connector.

The embodiment shown in FIGS. 13A-B and 14A-B illustrates the use of circumferential, stepped cutaway segments 106 and conductive shims 108 to provide a current path among strand layers 76 or conductor elements without the need to drive the fasteners to varying depths through a connector housing 51. During splicing, a series of circumferential segments 106 are cut from each successive conductor element or strand layer 76 to create a stepped configuration where, for example, a first circumferential segment 106*a* is removed from the outer most conductor element or strand layer 76, a second circumferential segment 106*b* is removed from the second outer most conductor element or strand layer 76, and so on. The stepped configuration is created by removing the circumferential segments 106 in an offsetting fashion along the axial direction of the cable.

A conductive shim 108 is then disposed about each conductor element or strand layer 76 to replace the volume of material subtracted by removal of the circumferential segments 106. The conductive shims 108 are, thus, installed in a concentric fashion so that each shim 108 can establish electrical communication with conductive shims 108 disposed about adjacent conductor elements or strand layers 76, which creates a current path among conductor elements or strand layers 76. A conventional shear-bolt or penetrating conductive fastener 70 is driven to a depth such that it establishes electrical communication with the conductive shim 108 disposed about the outermost conductor element or strand layer 76, thereby creating a current path among conductor elements or strand layers 76 via the conductive shims 108, fasteners 70, and connector housing 51, which eliminates the need to drive the fasteners 70 to varying depths through each conductor element or strand layer 76. In this configuration, the conventional shear-bolt or conductive penetrating fasteners 70 can be driven to a constant depth that contacts the outer most conductive shim 108 while still achieving enhanced connectability among conductor elements or strand layers 76.

Figure 15:
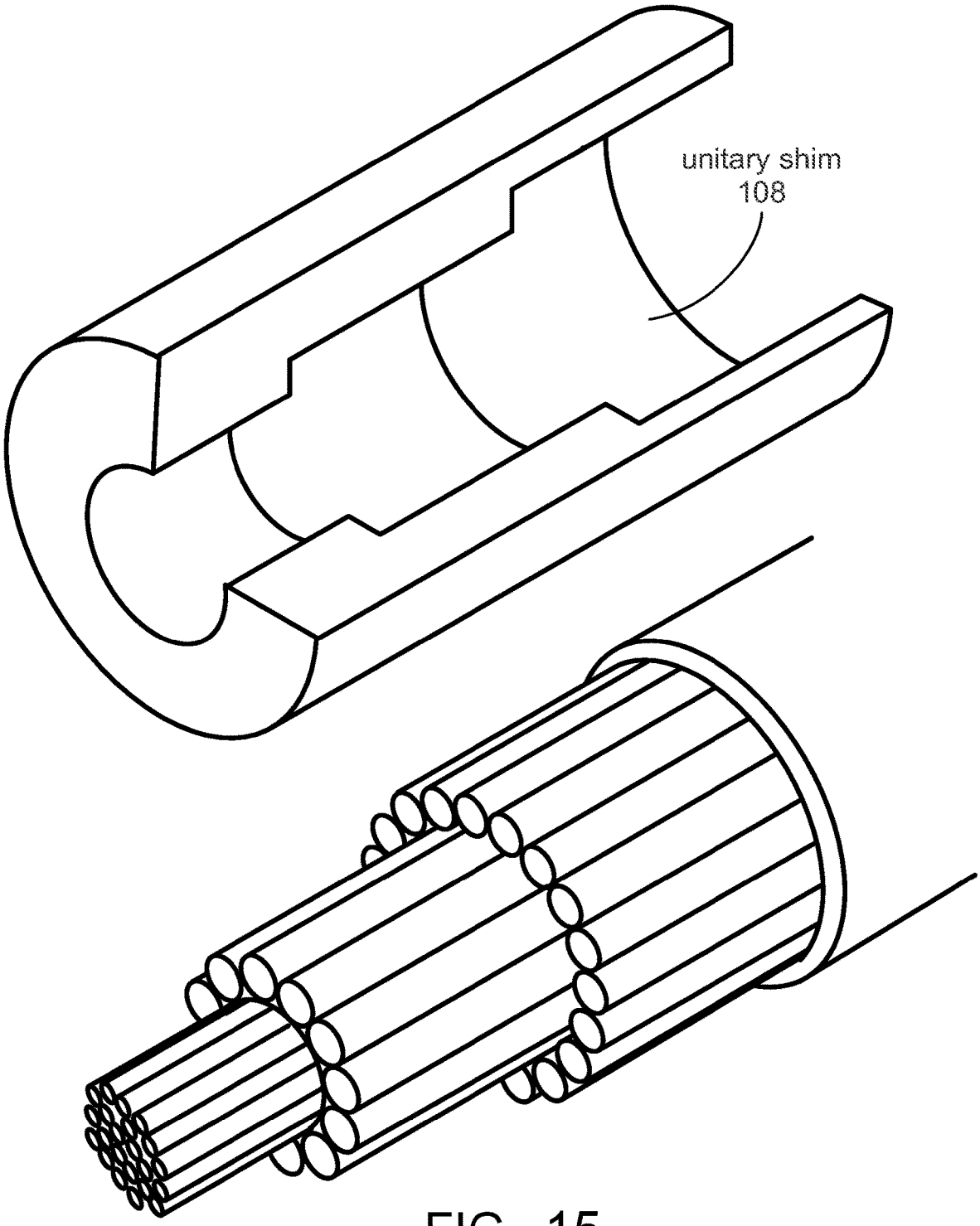
FIG. 15 illustrates a layered, stranded conductor with a stepped, unitary shim.

As an alternative to placing a separate conductive shim 108 about each conductor element or strand layer 76, a single unitary shim with a stepped or rabbeted interior surface 110 conforming to the conductive shim circumferential cutaway segments 106 can be used, as depicted in FIG. 15. The interior dimensions of the shim 108 are greater than the exterior dimensions of the conductor elements or strand layers 76 such that the shim 108 can be easily disposed about the conductor elements or strand layers 76. The unitary conductive shim 108 could also be formed with protrusions extending from the interior surface of the shim 108 that correspond to notches 102 in the conductor elements or strand layers 76 so that the shim 108 is placed in electrical communication with multiple conductor elements or strand layers 76 when disposed about the cable.

Figure 13A:
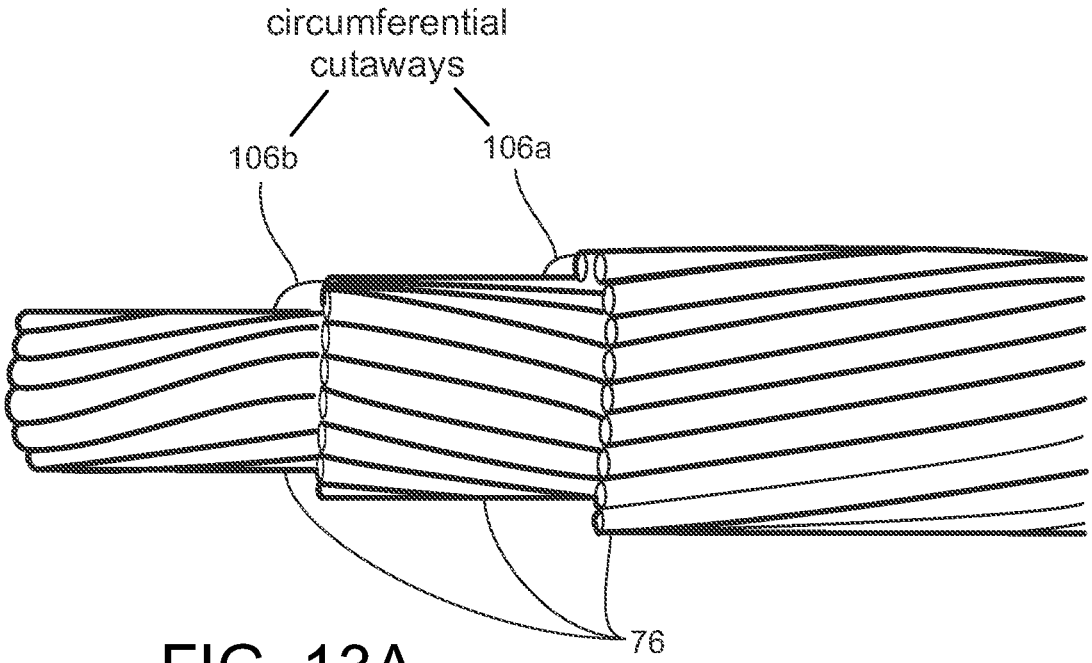
FIG. 13A illustrates a layered, stranded conductor with circumferential cutaways.
Figure 13B:
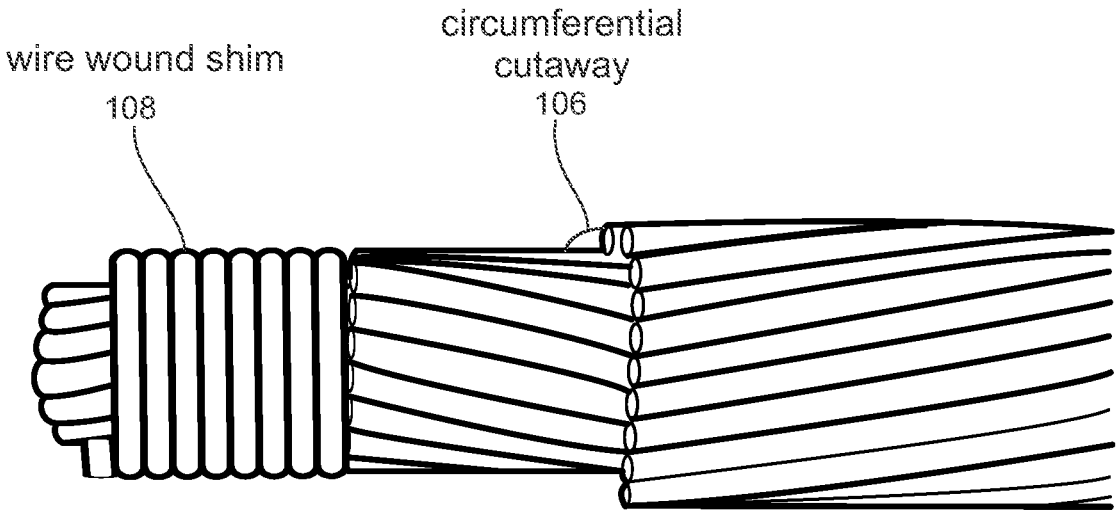
FIG. 13B illustrates a layered, stranded conductor with circumferential cutaways and a wire wound shim.
Figure 14B:
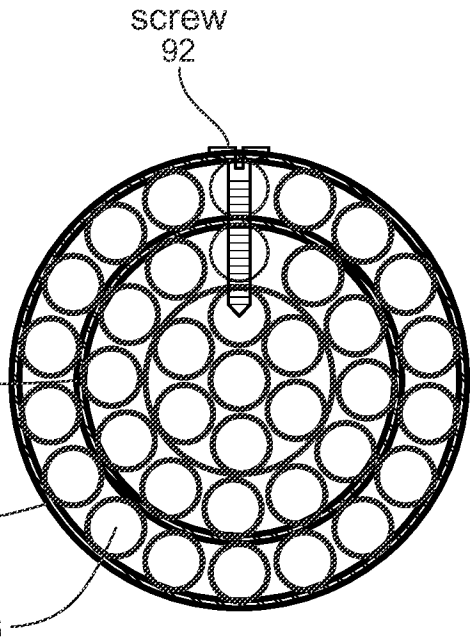
FIG. 14B is a cross-sectional view of a layered, stranded conductor with circumferential cutaways and shims.
Figure 14A:
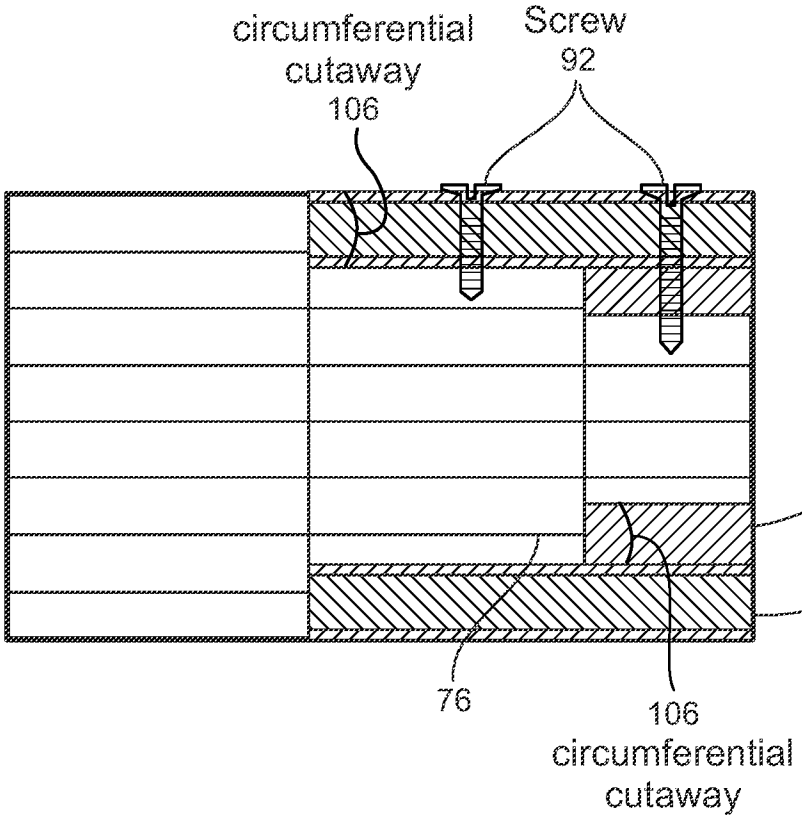
FIG. 14A is a side view of a layered, stranded conductor with circumferential cutaways including fixed shims with screws achieving electrical contact.
Figure 16:
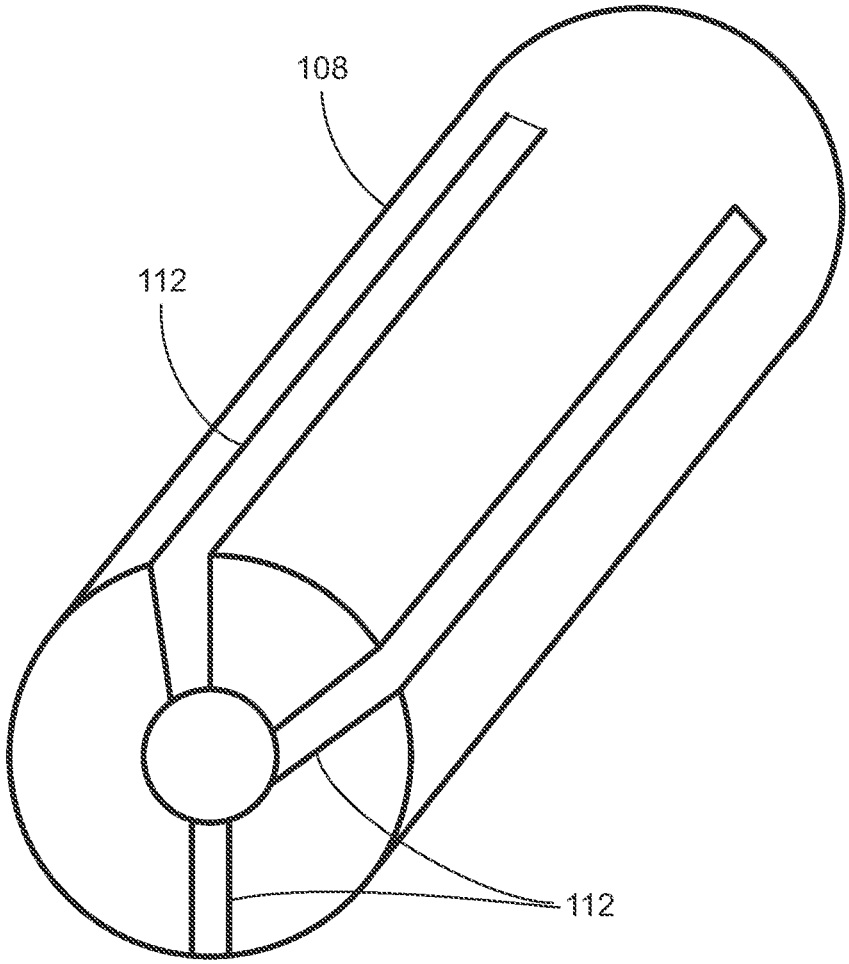
FIG. 16 illustrates a unitary shim with longitudinal slits.

The conductive shim 108 can be made compressible so that the shim 108 deforms to securely fit about the conductor element or strand layer 76 as the connector is crimped or secured with one or more fasteners about cable end portions 62 & 63 received within the connector socket 52. The conductive shim 108 can be formed from a compressible material or formed as a compressible helical element, as shown in FIG. 13B. The conductive shim 108 can, if needed, be formed from materials available in the field during connector installation, such as forming the helical shim shown in FIG. 13B using a segment of a conductor strand. In another embodiment depicted in FIG. 16, one or more longitudinal slits 112 are formed in the conductive shim 108 that run along the axial axis over the majority of the length of the shim so as to facilitate compression of the shim.

Figure 17:
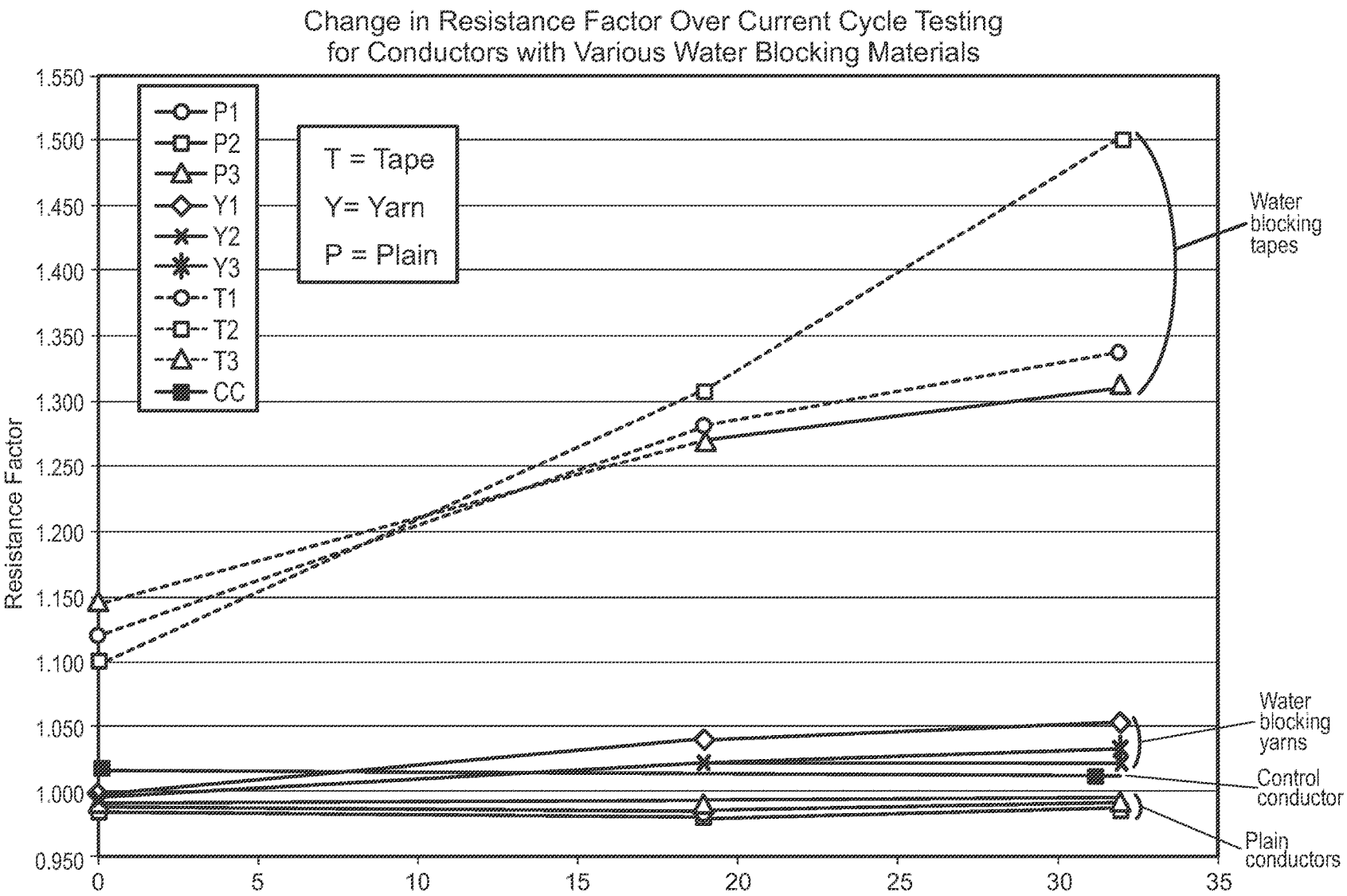
FIG. 17 is a graph of connector and conductor test loop resistance factor for various conductor configurations during current cycle testing.
Figure 18:
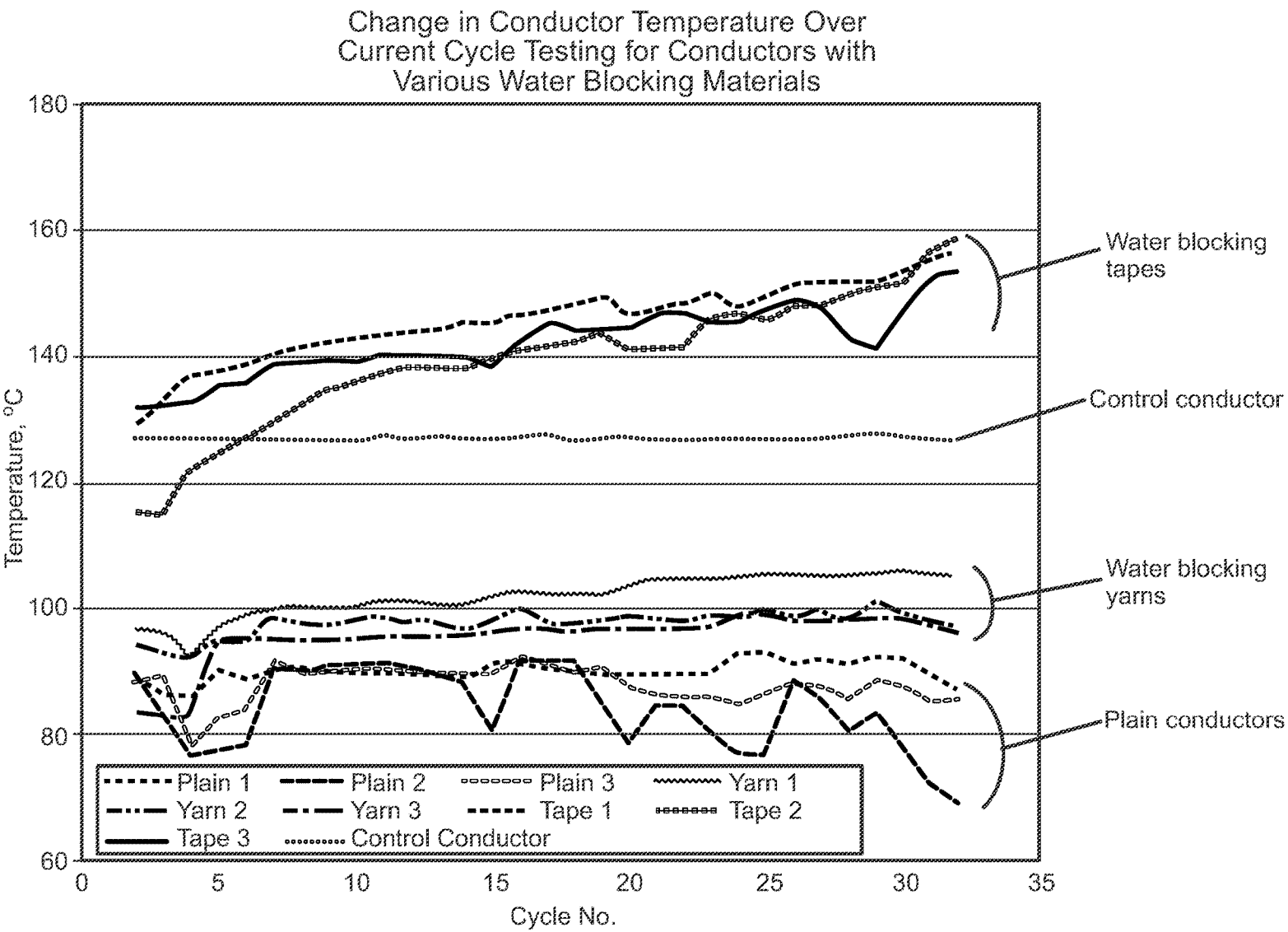
FIG. 18 is a graph of connector and conductor test loop temperature for various conductor configurations during current cycle testing.

The improved connectability of connector assemblies using the present devices and methods was validated through current cycling testing. Connector assemblies with and without water blocking materials were subjected to repeated loading cycles while suspended in air in a draft free room. Test conductor loops were tested against a straight conductor segments called control conductors that were placed in series with the test loop. Each load cycle was intended to bring the control conductor temperature to 100° C. above ambient with the duration of the cycle being long enough to stabilize the temperature within +/−2° C. According to industry standards, the resistance of the test loop and the temperature difference between a particular test loop and the control conductor should remain stable over the duration test through repeated load cycles. FIGS. 17 and 18 shows that this was not the case with conventional connector assemblies that do not use the inventive devices and methods described herein.

FIG. 17 illustrates the change in resistance factor for a 750 kcmil aluminum conductor used in various test loops over more than thirty test cycles. Use of a resistance factor facilitates comparison of different conductor sizes, samples, etc., and is defined as the ratio of the actual resistance of a sample to that of the nominal value for a plain conductor of the same length. A resistance factor below 1 indicates a relatively low resistance for a connector while an increase in resistance factor over time is an indication of connector degradation. The connectors with plain conductors (no water-blocking materials) remained relatively stable over time (bottom three lines) with a resistance factor less than the control conductor over the duration of the test cycling. The connectors with conductors having water-blocking yarns (three lines above the control conductor) showed a relatively slow increase in resistance over time while the connectors with conductors having water-blocking tapes (top three lines) demonstrated a sharp increase in resistance that can be considered a catastrophic runaway that would invariably lead to connector overheating and failure.

Similar results were reached with temperature testing, as illustrated in FIG. 18. The temperature of the control conductor remained relatively stable over more than thirty cycles as did the temperature of the connectors with plain conductors having no water-blocking materials. The connectors with a conductor using water-blocking yarns exhibited a slow increase in temperature over the course of the testing while connectors with conductors having water-blocking tapes exhibited a sharp temperature increase over time. Notably, aluminum splices begin degrading rapidly as temperatures reach approximately 140° C. due to annealing and creeping of the aluminum lattice. Thus, the connectors using water-blocking tapes shown in FIG. 18 would be particularly susceptible to failure given that the temperatures reached over 140° C. after less than fifteen cycles. Splices made of other materials would, of course, exhibit similar failures at various temperature points.

Figure 19:
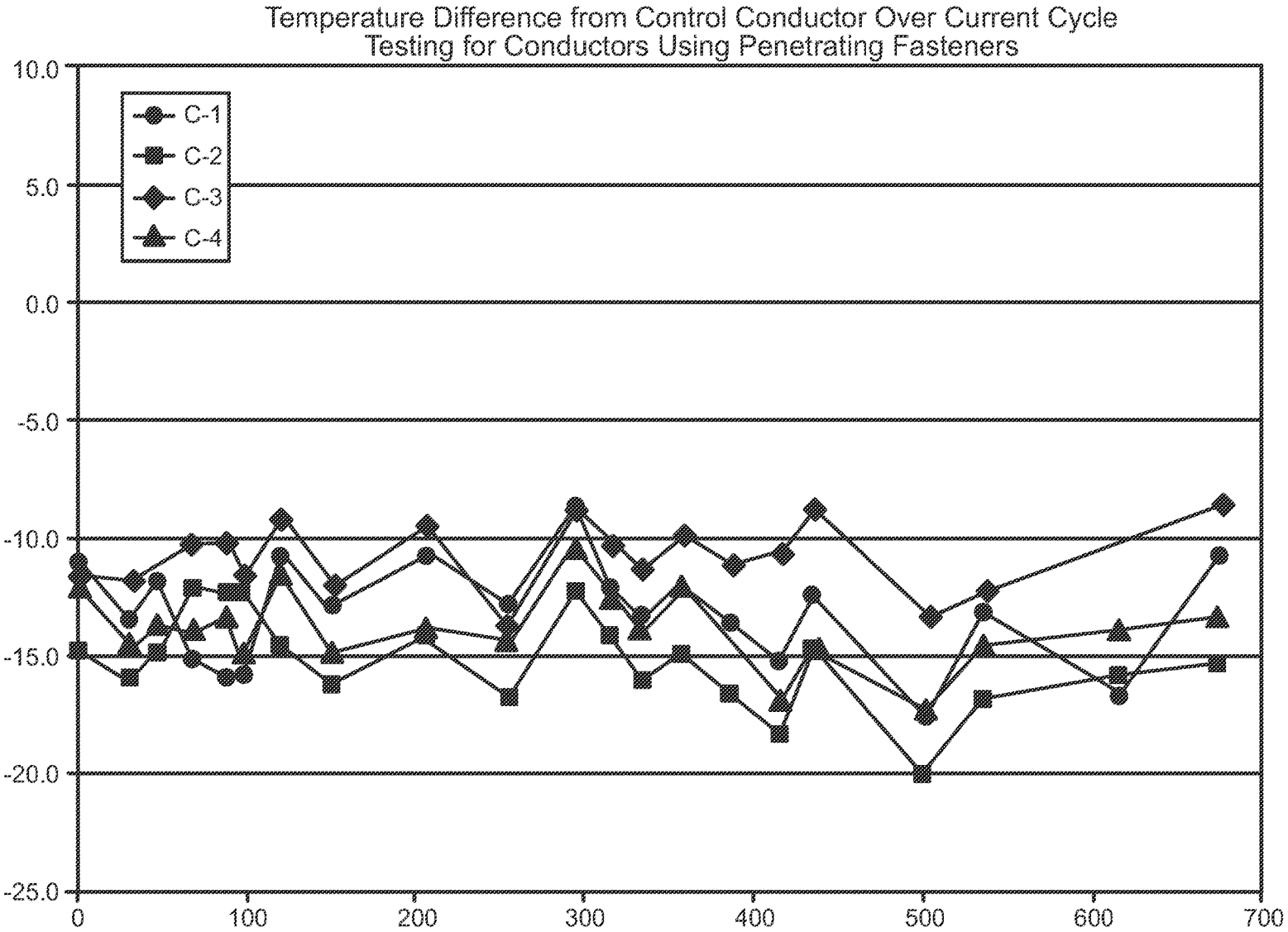
FIG. 19 is a graph of connector and conductor test loop temperature during current cycle testing for conductors using water-blocking tapes and conductive, penetrating shear-bolt fasteners.

The substantial improvements achieved using the inventive devices and methods described herein are illustrated in FIG. 19. For each of the lines show in FIG. 19, conductors having water blocking tapes were used with a connector assembly having penetrating fasteners to establish a current path between conductor strand layers. Even though conductors having water-blocking tapes performed the worst in the test shown in FIGS. 17 and 18, the connectors shown in FIG. 19 exhibited a relatively stable temperature below that of the control conductor over approximately 675 load cycles.

Although the foregoing description provides embodiments of the invention by way of example, it is envisioned that other embodiments may perform similar functions and/or achieve similar results. Any and all such equivalent embodiments and examples are within the scope of the present invention.

What is claimed is:

1. An electrical connector assembly comprising:

(a) an electrical conductor having (i) at least two conducting layers, wherein each conducting layer comprises multiple conductor strands, and (ii) a semi-conducting or insulating material disposed between the conductor strands;

(b) a connector having a housing that comprises (i) a first axis extending between a first end with a first opening and a second end, and (ii) a second axis transverse to the first axis, and (iii) an exterior surface;

(c) a socket cavity at least partially collocated with the first opening, wherein the socket cavity (i) extends along the first axis, (ii) defines an interior surface of the housing, and (iii) is sized to receive the electrical conductor; and (d) a passage through the housing, wherein (i) the passage extends along the second axis from the housing exterior surface to the housing interior surface, and (ii) the passage is sized to accommodate a conductive fastener, wherein (A) the conductive fastener comprises a first fastener penetrating end formed with a pointed tip, a second fastener end, and a fastener first length extending between the first fastener penetrating end and the second fastener end, and wherein (B) the fastener first length is sized so that when the socket cavity receives the electrical conductor and the conductive fastener is secured within the passage, the first fastener penetrating end and at least part of the first conductive fastener length (i) extend into the socket cavity, (ii) extend into the electrical conductor between conductor strands and displace the conductor strands, and (iii) extend through the semi-conducting or insulating material to establish electrical communication with the at least two conducting layers.

2. The electrical connector assembly of claim 1, wherein the conductive fastener is selected from the group consisting of a shear bolt, a screw, or a rivet.

3. The electrical connector assembly of claim 1, wherein the conductive fastener is a shear bolt having a plurality of break points.

4. The electrical connector assembly of claim 1, wherein the connector is a crimp connector.

5. The electrical connector assembly of claim 1, wherein the passage is formed by driving the conductive fastener into the housing exterior surface.

6. The electrical connector assembly of claim 4, wherein the passage is formed by driving the conductive fastener into the housing exterior surface.

7. The electrical connector assembly of claim 1, wherein the assembly further comprises a second electrical conductor having (i) at least two conducting layers, wherein each conducting layer comprises multiple conductor strands, and (ii) a semi-conducting or insulating material disposed between the conductor strands:

(a) the housing second end includes a second opening;

(b) the socket cavity defines a channel extending from the first opening to the second opening, wherein the second opening is sized to receive the second electrical conductor;

(c) the passage defines an aperture on the housing exterior surface, wherein the aperture is located a first distance from the housing first end; and wherein (d) the connector housing further comprises a second passage, wherein (i) the second passage extends along a third axis transverse to the first axis from the housing exterior surface to the housing interior surface, (ii) the second passage defines a second aperture on the housing exterior surface that is located a second distance from the first opening, wherein the second distance is greater than the first distance, and (iii) the second passage is sized to accommodate a second conductive fastener, wherein (A) the second conductive fastener comprises a third fastener, penetrating end formed with a pointed tip, a fourth fastener end, and a fastener second length extending between the third fastener end and the fourth fastener end, and wherein (B) the fastener second length is sized so that when the socket cavity receives the second electrical conductor and the second conductive fastener is secured within the second passage, the third fastener penetrating end and at least part of the second conductive fastener length (i) extends into the socket cavity, (ii) extends into the second electrical conductor between conductor strands and displaces the conductor strands, and (iii) extends through the semi-conducting or insulating material to establish electrical communication with the at least two conducting layers of the second electrical conductor.

8. The electrical connector assembly of claim 7, wherein the conductive fastener is selected from the group consisting of a shear bolt, a screw, or a rivet.

9. The electrical connector assembly of claim 8, wherein the second conductive fastener is selected from the group consisting of a shear bolt, a screw, or a rivet.

10. An electrical connector assembly comprising:

(a) an electrical conductor having (ii) a first conducting layer and a second conducting layer, wherein the first conducting layer and the second conducting layer both comprise multiple conductor strands, (ii) a semi-conducting or insulating material disposed between the conductor strands, and wherein (iii) the first conducting layer comprises a cutaway segment defined by the removal of a portion of the multiple conductor strands and the semi-conducting or insulating material;

(b) a connector having a housing that comprises (i) a first axis extending between a first end with a first opening and a second end, and (ii) a second axis transverse to the first axis, and (iii) an exterior surface;

(c) a socket cavity at least partially collocated with the first opening, wherein the socket cavity (i) extends along the first axis, (ii) defines an interior surface of the housing, and (iii) is sized to receive the electrical conductor;

(d) a first passage through the housing, wherein (i) the first passage extends along the second axis from the housing exterior surface to the housing interior surface, and (ii) the first passage is sized to accommodate a first conductive fastener, wherein (A) the first conductive fastener comprises a first fastener end, a second fastener end, and a fastener first length extending between the first fastener end and the second fastener end, and wherein (B) the fastener first length is sized so that when the socket cavity receives the electrical conductor and the first conductive fastener is secured within the first passage, the first fastener end extends into the socket cavity and establishes electrical communication with the first conducting layer; and (e) a second passage through the housing, wherein (i) the second passage extends along the second axis from the housing exterior surface to the housing interior surface, and (ii) the second passage is sized to accommodate a second conductive fastener, wherein (A) the second conductive fastener comprises a third fastener end, a fourth fastener end, and a fastener second length extending between the third fastener end and the fourth fastener end, and wherein (B) the fastener second length is sized so that when the socket cavity receives the electrical conductor and the second conductive fastener is secured within the second passage, the third fastener end extends into the socket cavity and establishes electrical communication with a second conducting layer.

11. The electrical connector assembly of claim 10, wherein:

(a) when the socket cavity receives the electrical conductor, the second passage is aligned with the cutaway segment; and wherein (b) the conductive fastener establishes electrical communication with the second conducting layer by extending through the second passage and through the cutaway segment to engage the second conducting layer.

12. The electrical connector assembly of claim 11, wherein:

(a) the first conducting layer and the second conducting layer are concentric; and wherein (b) the cutaway segment is a notch.

13. The electrical connector assembly of claim 11, wherein:

(a) the first conducting layer and the second conducting layer are concentric; and wherein (b) the cutaway segment has a segment length extending along the first axis, and the cutaway segment is formed by removing the entire cross section of the first conducting layer across the segment length.

14. The electrical connector assembly of claim 10, wherein:

(a) the first conducting layer and the second conducting layer are concentric;

(b) the cutaway segment has a segment length extending along the first axis, and the cutaway segment is formed by removing the entire cross section of the first conducting layer across the segment length;

(c) a conductive shim is disposed about the second conducting layer at least partially within the cutaway segment, wherein the conductive shim is in electrical communication with the second conducting layer; and wherein (d) the second conductive fastener is in electrical communication with the second conducting layer by extending through the second passage to engage the conductive shim.

15. The electrical connector assembly of claim 10, wherein:

(a) a conductive shim disposed at least partially within the cutaway segment, wherein the conductive shim is in electrical communication with the second conducting layer;

(b) the second conductive fastener establishes electrical communication with the second conducting layer by extending through the second passage to engage the conductive shim.

16. The electrical connector assembly of claim 10, wherein:

(a) a conductive shim is disposed about the first conducting layer at least partially within the cutaway segment and disposed about the second conducting layer, wherein the conductive shim is in electrical communication with both the first conducting layer and the second conducting layer; and wherein (b) the second conductive fastener establishes electrical communication with both the first conducting layer and the second conducting layer by extending through the second passage to engage the conductive shim.

17. The electrical connector assembly of claim 15, wherein the conductive shim is formed from a malleable material.

18. The electrical connector assembly of claim 15, wherein the conductive shim comprises (i) an elongated hollow body having a longitudinal axis and a shim length, and (ii) a slit in the hollow body, wherein the slit extends in the direction of the longitudinal axis and has a slit length that is less than the shim length.

19. A method for establishing an electrical connection comprising the steps of:

(a) providing an electrical conductor having at least two conducting layers, wherein each conducing layer comprises multiple conductor strands;

(b) providing a connector having a housing comprising:

(i) a first axis extending between a first end with a first opening and a second end, (ii) a second axis transverse to the first axis, (iii) an exterior surface;

(iv) a socket cavity at least partially collocated with the first opening, wherein the socket cavity (A) extends along the first axis, (B) defines an interior surface of the housing, and (C) is sized to receive the electrical conductor; and (v) a first passage through the housing, wherein (A) the first passage extends along the second axis from the housing exterior surface to the housing interior surface, and (B) the first passage is sized to accommodate a first conductive fastener;

(c) providing the first conductive fastener comprising first fastener penetrating end formed with a pointed tip, a second fastener end, and a fastener first length extending between the first fastener end and the second fastener end;

(d) inserting the electrical conductor into the first opening and into the socket cavity; and (e) inserting the first conductive fastener into the first passage to a depth such that the first conductive fastener penetrating end and at least a portion of the fastener first length (i) extend into the socket cavity, and (ii) extend into the electrical conductor between conductor strands and displace the conductor strands to establish electrical communication with the at least two conducting layers.

20. The method for establishing an electrical connection of claim 19, wherein:

(a) the connector housing further comprises a second passage through the housing, wherein (A) the second passage extends along the second axis from the housing exterior surface to the housing interior surface, and (B) the second passage is sized to accommodate a second conductive fastener, (b) the electrical conductor comprises a first conducting layer having a cutaway segment defined by the removal of a portion of the conductor strands and the semi-conducting or insulating material and a second conducting layer;

(c) the first conductive fastener establishes electrical communication with the first conducting layer by extending through the first passage to engage the first conducting layer; and (d) the second conductive fastener establishes electrical communication with the second conducting layer by extending through the second passage and into the cutaway segment to engage the second conducting layer.

21. The method for establishing an electrical connection of claim 20, wherein the method further comprises the steps of:

(a) providing a conductive shim; and (b) installing the conductive shim at least partially within the cutaway segment, wherein (A) the conductive shim is in electrical communication with a second conducting layer, and wherein (B) the second conductive fastener establishes electrical communication with the second conducting layer by extending through the second passage to engage the conductive shim within the cutaway segment.

* * * * *